US007684576B2

(12) United States Patent
Bank et al.

(10) Patent No.: US 7,684,576 B2
(45) Date of Patent: Mar. 23, 2010

(54) RESONANT ELEMENT TRANSDUCER

(75) Inventors: Graham Bank, Suffolk (GB); Neil Harris, Cambridge (GB); Martin Colloms, London (GB)

(73) Assignee: New Transducers Limited, Huntingdon (GB)

( * ) Notice: Subject to any disclaimer, the term of this patent is extended or adjusted under 35 U.S.C. 154(b) by 739 days.

(21) Appl. No.: 11/636,476

(22) Filed: Dec. 11, 2006

(65) Prior Publication Data

US 2007/0086616 A1 Apr. 19, 2007

Related U.S. Application Data

(63) Continuation of application No. 09/768,002, filed on Jan. 24, 2001, now Pat. No. 7,149,318.

(60) Provisional application No. 60/178,315, filed on Jan. 27, 2000, provisional application No. 60/205,465, filed on May 19, 2000, provisional application No. 60/218,062, filed on Jul. 13, 2000.

(30) Foreign Application Priority Data

| | | |
|---|---|---|
| Jan. 24, 2000 | (GB) | 0001492.8 |
| Apr. 20, 2000 | (GB) | 0009705.5 |
| May 15, 2000 | (GB) | 0011602.0 |

(51) Int. Cl.
*H04R 25/00* (2006.01)
*H04R 7/04* (2006.01)

(52) U.S. Cl. ..... 381/190; 381/152

(58) Field of Classification Search ..... 381/150, 381/151, 152, 186, 190, 337, 386, 396, 398; 310/322, 324, 326, 354; 181/150, 157, 161, 181/173

See application file for complete search history.

(56) References Cited

U.S. PATENT DOCUMENTS

| | | | |
|---|---|---|---|
| 3,109,153 | A | 10/1963 | Rodek |
| 4,078,160 | A | 3/1978 | Bost |
| 4,352,961 | A | 10/1982 | Kumada et al. |

(Continued)

FOREIGN PATENT DOCUMENTS

| | | |
|---|---|---|
| EP | 0 711 096 | 5/1996 |

(Continued)

OTHER PUBLICATIONS

Bost et al., An Audo Engineering Society Preprint (AES) Presented at the 60th Convention, May 2-5, 1978, "A New Piezoelectric Driver Enhances Horn Performance," Preprint No. 1374 (D-6), pp. 1-14.

(Continued)

*Primary Examiner*—Brian Ensey
(74) *Attorney, Agent, or Firm*—Roylance, Abrams, Berdo & Goodman, L.L.P.

(57) ABSTRACT

A transducer (14) for producing a force which excites an acoustic radiator, e.g. a panel (12) to produce an acoustic output. The transducer (14) has an intended operative frequency range and comprises a resonant element which has a distribution of modes and which is modal in the operative frequency range. Parameters of the transducer (14) may be adjusted to improve the modality of the resonant element. A loudspeaker (10) or a microphone may incorporate the transducer.

31 Claims, 17 Drawing Sheets

U.S. PATENT DOCUMENTS

| | | | |
|---|---|---|---|
| 4,367,426 | A | 1/1983 | Kumada et al. |
| 4,401,857 | A | 8/1983 | Morikawa |
| 4,414,436 | A | 11/1983 | Sashida et al. |
| 4,481,663 | A | 11/1984 | Spranger |
| 4,593,160 | A | 6/1986 | Nakamura |
| 4,820,952 | A | 4/1989 | Lee |
| 4,940,914 | A | 7/1990 | Mizuno et al. |
| 5,632,841 | A | 5/1997 | Hellbaum et al. |
| 5,736,808 | A | 4/1998 | Szilagyi et al. |
| 5,802,195 | A | 9/1998 | Regan et al. |
| 6,031,926 | A | 2/2000 | Azima et al. |
| 6,195,440 | B1 | 2/2001 | Warnaka et al. |
| 6,215,884 | B1 | 4/2001 | Parrella et al. |
| 6,332,029 | B1 | 12/2001 | Azima et al. |
| 6,377,695 | B1 | 4/2002 | Azima et al. |
| 6,396,197 | B1 | 5/2002 | Szilagyi et al. |
| 6,427,017 | B1 | 7/2002 | Toki |
| 6,480,614 | B1 | 11/2002 | Denda et al. |
| 6,519,346 | B1 | 2/2003 | Asada et al. |
| 6,554,098 | B1 | 4/2003 | Komura |
| 6,621,908 | B2 | 9/2003 | Asada et al. |
| 7,149,318 | B2 | 12/2006 | Bank et al. |
| 7,151,837 | B2 | 12/2006 | Bank et al. |
| 2001/0026626 | A1 | 10/2001 | Athanas |
| 2001/0033669 | A1 | 10/2001 | Bank et al. |
| 2003/0002697 | A1 | 1/2003 | Mellow |
| 2003/0053642 | A1 | 3/2003 | Bank et al. |
| 2003/0059069 | A1 | 3/2003 | Bank et al. |

FOREIGN PATENT DOCUMENTS

| | | |
|---|---|---|
| EP | 0 881 856 | 12/1998 |
| EP | 0 993 231 | 4/2000 |
| FR | 2 649 575 | 1/1991 |
| GB | 2 166 022 | 4/1986 |
| WO | WO 83/02364 | 7/1983 |
| WO | WO 96/31333 | 10/1996 |
| WO | WO 97/09842 | 3/1997 |
| WO | WO 97/09844 | 3/1997 |
| WO | WO 97/09846 | 3/1997 |
| WO | WO 97/09854 | 3/1997 |
| WO | WO 98/42536 | 10/1998 |
| WO | WO 98/52383 | 11/1998 |
| WO | WO 98/58416 | 12/1998 |
| WO | WO 98/58521 | 12/1998 |
| WO | WO 99/08479 | 2/1999 |
| WO | WO 99/11490 | 3/1999 |
| WO | WO 99/37121 | 7/1999 |
| WO | WO 99/41939 | 8/1999 |
| WO | WO 00/02417 | 1/2000 |
| WO | WO 00/13464 | 3/2000 |
| WO | WO 00/33612 | 6/2000 |
| WO | WO 00/45616 | 8/2000 |
| WO | WO 00/48425 | 8/2000 |
| WO | WO 01/54450 | 7/2001 |

OTHER PUBLICATIONS

Bost, Jonathan A., et al., "A New Piezoelectric Driver Enhances Horn Performance," An Audio Engineering Society Preprint, Preprint No. 1374 (D-6), presented at the 60$^{th}$ Convention, May 2-5, 1978, pp. 1-14.

RESONANT ELEMENT TRANSDUCER

This application is a continuation of application Ser. No. 09/768,002, filed Jan. 24, 2001, which claims the benefit of provisional application Nos. 60/178,315, filed Jan. 27, 2000; 60/205,465, filed May 19, 2000; and 60/218,062, filed Jul. 13, 2000.

TECHNICAL FIELD

The invention relates to transducers, actuators or exciters, particularly but not exclusively transducers for use in acoustic devices, e.g. loudspeakers and microphones.

BACKGROUND ART

A number of transducer, exciter or actuator mechanisms have been developed to apply a force to a structure, e.g. an acoustic radiator of a loudspeaker. There are various types of these transducer mechanisms, for example moving coil, moving magnet, piezoelectric or magnetostrictive types. Typically, electrodynamic speakers using coil and magnet type transducers lose 99% of their input energy to heat whereas a piezoelectric transducer may lose as little as 1%. Thus, piezoelectric transducers are popular because of their high efficiency.

There are several problems with piezoelectric transducers, for example, they are inherently very stiff, for example comparable to brass foil, and are thus difficult to match to an acoustic radiator, especially to the air. Raising the stiffness of the transducer moves the fundamental resonant mode to a higher frequency. Thus such piezoelectric transducers may be considered to have two operating ranges. The first operating range is below the fundamental resonance of the transducer. This is the "stiffness controlled" range where velocity rises with frequency and the output response usually needs equalisation. This leads to a loss in available efficiency. The second range is the resonance range beyond the stiffness range, which is generally avoided because the resonances are rather fierce.

Moreover, general teaching is to suppress resonances in a transducer, and thus piezoelectric transducers are generally used only used in the frequency range below or at the fundamental resonance of the transducer. Where piezoelectric transducers are used above the fundamental resonance frequency it is necessary to apply damping to suppress resonance peaks.

The problems associated with piezoelectric transducers similarly apply to transducers comprising other "smart" materials, i.e. magnetostrictive, electrostrictive, and electret type materials.

It is known from EP 0 711 096 A1 of Shinsei Corporation to provide a sound generating device in which a driving device of an acoustic vibration plate is arranged between a speaker frame and the acoustic vibration plate. The driving device is comprised of a pair of piezoelectric vibration plates arranged facing each other across a certain distance. The outer peripheries of the piezoelectric vibration plates are connected to each other by an annular spacer. When a drive signal is applied to the piezoelectric vibration plates, the piezoelectric vibration plates repeatedly undergo flexing motion wherein their centres flex alternately in opposite directions. The flexing directions of the piezoelectric vibration plates are always reverse to each other.

It is known from EP 0881 856A of Shinsei Corporation to provide an acoustic piezoelectric vibrator and loudspeaker using the same, wherein an oscillation controlling piece of elastomer is attached to the periphery of a piezoelectric oscillation plate. The oscillation controlling piece is shaped so that a distance between an axis passing by a centre of the piezoelectric oscillation plate, which is perpendicular to a straight line connecting a centre of the piezoelectric oscillation plate to the centre of gravity of the oscillation controlling piece, and a mass centre line of the oscillation controlling piece varies along the axis, or so that a mass of each of sections of the oscillation controlling piece divided by a plurality of straight lines parallel to a straight line connecting a centre of the piezoelectric oscillation plate to the centre of gravity of the oscillation controlling piece varies along an axis which is perpendicular to the straight line and passes through the centre of the piezoelectric oscillation plate.

U.S. Pat. No. 4,593,160 OF Murata Manufacturing Co. Limited discloses a piezoelectric speaker comprising a piezoelectric vibrator for vibrating in a bending mode, which is supported at its longitudinal intermediate position by a support member, whereby first and second portions of the piezoelectric vibrator on both sides of the support member are respectively supported in a cantilever manner. The piezoelectric vibrator is connected at portions close to both ends thereof with a diaphragm by coupling members formed by wires, whereby bending vibration of the piezoelectric vibrator is transferred to the diaphragm thereby to drive the diaphragm. The position of the support member with respect to the piezoelectric vibrator is so selected that the resonance frequency of the first portion is smaller than the corresponding resonance frequency of the second portion, and the primary resonance frequency (f1) of the second portion is so selected as to be substantially at the centre value of the first resonance frequency (F1) and the second resonance frequency (F2) of the first portion on logarithmic coordinates.

U.S. Pat. No. 4,401,857 of Sanyo Electric Co Limited discloses a piezoelectric cone-type speaker having a multiple structure in which a plurality of piezoelectric elements and speaker diaphragms individually coupled to them are coaxially or multi-axially arranged. A cushioning member is interposed between one diaphragm and another so that each element is isolated from the vibrations of another element.

U.S. Pat. No. 4,481,663 of Altec Corporation discloses a network for matching an electrical source of audio signals to a piezoceramic driver for a high frequency loudspeaker. The network consists of all of the elements of a bandpass filter network, but with the parallel combination of an inductor and a capacitor in the output stage of the filter replaced by an autotransformer or autoinductor which transforms the input impedance of the piezoceramic transducer into an equivalent parallel capacitance and resistance which, together with the inductance of the autotransformer, supply the load resistance for the filter and replace the capacitor and inductor omitted from the output stage of the bandpass network. An additional shunt resistor may be placed across the output of the autotransformer to obtain the desired effective load resistance at the input of the autotransformer.

UK patent application GB 2,166,022A of Sawafuji discloses a piezoelectric speaker including a plurality of piezoelectric vibrating elements, each including a piezoelectric vibrating plate and a weight connected to the plate near the point of centre of gravity thereof through a viscoelastic layer, and having the vibramotive force designed to be taken out of the outer edge thereof. The piezoelectric vibrating elements are connected at their peripheral ends to each other through connectors, one of the elements being connected at its peripheral edge directly to a cone type acoustic radiator to give the radiator a vibramotive force mainly in a high-frequency portion, and the remaining elements adjacent thereto producing a vibramotive force adapted to share middle- and low-frequency portions for energization of the cone type acoustic radiator.

It is an object of the present invention to provide an improved transducer.

SUMMARY OF THE INVENTION

According to the invention, there is provided an electromechanical force transducer, e.g. for applying a force which excites an acoustic radiator to produce an acoustic output, the transducer having an intended operative frequency range, comprising a resonant element having a frequency distribution of modes in the operative frequency range, and a mount on the resonant element for mounting the transducer to a site to which force is to be applied. The transducer may thus be considered to be an intendedly modal transducer. The mount may be attached to the resonant element at a position which is beneficial for coupling modal activity of the resonant element to the site.

The resonant element may be passive and may be coupled by a connector to an active transducer element which may be a moving coil, a moving magnet, a piezoelectric, a magnetostrictive or an electret device. The connector may be attached to the resonant element at a position which is beneficial for enhancing modal activity in the resonant element. The passive resonant element may act as a near low loss, resistive mechanical load to the active element and may improve power transfer and mechanical matching of the active element to a diaphragm to which force is to be applied. Thus, in principle the passive resonant element may act as a short term resonant store. The passive resonant element may have low natural resonant frequencies so that its modal behaviour is satisfactorily dense in the range where it performs its loading and matching action for the active element. One effect of the designed close coupling of an active element to such a resonant member is to blend the force produced by the transducer more evenly over the frequency range. This is achieved by cross coupling and control of extreme Q values and the result is a smoother frequency response, potentially better than simple piezo devices.

Alternatively, the resonant element may be active and may be a piezoelectric, a magnetostrictive, an electrostrictive or an electret device. The piezoelectric active element may be prestressed, for example as described in U.S. Pat. No. 5,632,841 or may be electrically prestressed or biased.

The active element may be a bi-morph, a bi-morph with a central vane or substrate or a uni-morph. The active element may be fixed to a backing plate or shim which may be a thin metal sheet and may have a similar stiffness to that of the active element. The backing sheet is preferably larger than the active element. The backing sheet may have a diameter or width which is two, three or four times greater than a diameter or width of the active element. The parameters of the backing plate may be adjusted to enhance the modal density of the transducer. The parameters of the backing plate and the parameters of the active element may be cooperatively adjusted to enhance modal density.

The resonant member may be perforate so as not to radiate undesired sound. Alternatively, the resonant member may have an acoustic aperture which is small to moderate acoustic radiation therefrom. The resonant member may be thus acoustically substantially inactive. Alternatively, the resonant member may contribute to the action of the assembly.

The size of the mount may be small, i.e. may be comparable with the wavelength of waves in the operative frequency range. This may improve the acoustic coupling therefrom. This may also reduce the higher frequency aperture effect, i.e., the possible decrease in high frequency coupling or bending waves resulting from the area of the coupling. Alternatively, the area of the resonant member may be chosen to selectively limit the higher frequency coupling, for example to provide a filtering function.

The parameters, e.g. aspect ratio, isotropy of bending stiffness, isotropy of thickness and geometry, of the resonant element may be selected to enhance the distribution of modes in the resonant element in the operative frequency range. Analysis, e.g. computer simulation using FEA or modelling, may be used to select the parameters.

The distribution may be enhanced by ensuring that a first mode of the active element is near to the lowest operating frequency of interest. The distribution may also be enhanced by ensuring a satisfactory, e.g. high, density of modes in the operative frequency range. The density of modes is preferably sufficient for the active element to provide an effective mean average force which is substantially constant with frequency. Good energy transfer may provide beneficial smoothing of modal resonances.

In contrast, for prior art transducers which comprise smart materials and which are designed to operate below the fundamental resonance of the prior art transducers, output would fall with decreasing frequency. This necessitates an increase in input voltage in order to keep the output constant with frequency.

Alternatively, or additionally, the distribution of modes may be enhanced by distributing the resonant bending wave modes substantially evenly in frequency, i.e. to smooth peaks in the frequency response caused by "bunching" or clustering of the modes. Such a transducer may thus be termed a distributed mode transducer or DMT.

By distributing the modes, the usual dominant high amplitude resonance of the resonant element is reduced and hence the peak amplitude of the resonant element is also reduced. Thus, the potential for fatigue of the transducer is reduced and operational life should be significantly extended. Moreover, the potential for a uniform response from a displacement type transducer eases the electrical demand, reducing the cost of the driven system.

The transducer may comprise a plurality of resonant elements each having a distribution of modes, the modes of the resonant elements being arranged to interleave in the operative frequency range and thus enhance the distribution of modes in the transducer as a whole device. The resonant elements preferably have different fundamental frequencies. Thus, the parameters, e.g. loading, geometry or bending stiffness of the resonant elements, may be different.

The resonant elements may be coupled together by at least one element link in any convenient way, e.g. on generally stiff stubs, between the elements. The resonant elements are preferably coupled at coupling points which enhance the modality of the transducer and/or enhance the coupling at the site to which the force is to be applied. Parameters of the element link(s) may be selected to enhance the modal distribution in the resonant elements.

The resonant elements may be arranged in a stack. The coupling points may be axially aligned. The resonant devices may be passive or active or combinations of passive and active devices to form a hybrid transducer.

The resonant element may be plate-like or may be curved out of planar. A plate-like resonant element may be formed with slots or discontinuities to form a multi-resonant system. The resonant element may be in the shape of a beam, trapezoidal, hyperelliptical or may be generally disc shaped. Alternatively, the resonant element may be rectangular and may be curved out of the plane of the rectangle about an axis along the short axis of symmetry. Such a transducer of plain strip geometry is taught in U.S. Pat. No. 5,632,841.

The resonant element may be modal along two substantially normal axes, each axis having an associated fundamental frequency. The ratio of the two fundamental frequencies may be adjusted for best modal distribution, e.g. 9:7 (~1.286:1).

As examples, the arrangement of such modal transducer may be any of: a flat piezoelectric disc; a combination of at least two or preferably at least three flat piezoelectric discs; two coincident piezoelectric beams; a combination of multiple coincident piezoelectric beams; a curved piezoelectric plate; a combination of multiple curved piezoelectric plates or two coincident curved piezoelectric beams.

The interleaving of the distribution of the modes in each resonant element may be enhanced by optimising the frequency ratio of the resonant elements, namely the ratio of the frequencies of each fundamental resonance of each resonant element. Thus, the parameter of each resonant element relative to one another may be altered to enhance the overall modal distribution of the transducer.

When using two active resonant elements in the form of beams, the two beams may have a frequency ratio (i.e. ratio of fundamental frequency) of 1.27:1. For a transducer comprising three beams, the frequency ratio may be 1.315:1.147:1. For a transducer comprising two discs, the frequency ratio may be 1.1+/−0.02 to 1 to optimise high order modal density or may be 3.2 to 1 to optimise low order modal density. For a transducer comprising three discs, the frequency ratio may be 3.03:1.63:1 or may be 8.19:3.20:1.

The transducer may be an inertial electro-mechanical force transducer. The transducer may be coupled to an acoustic radiator to excite the acoustic radiator to produce an acoustic output.

Thus according to a second aspect of the invention, there is provided a loudspeaker comprising an acoustic radiator and a modal transducer as defined above, the transducer being coupled via a mount to the acoustic radiator to excite the acoustic radiator to produce an acoustic output. The parameters of the mount may be selected to enhance the distribution of modes in the resonant element in the operative frequency range. The mount may be vestigial, e.g. a controlled layer of adhesive.

The mount may be positioned asymmetrically with respect to the acoustic radiator so that the transducer is coupled asymmetrically to the acoustic radiator. The asymmetry may be achieved in several ways, for example by adjusting the position or orientation of the transducer on the acoustic radiator with respect to axes of symmetry in the acoustic radiator or the transducer.

The mount may form a line of attachment. Alternatively, the mount may form a point or small local area of attachment where the area of attachment is small in relation to the size of the resonant element. The mount may be in the form of a stub and have a small diameter, e.g. 3 to 4 mm. The mount may be low mass.

The mount may comprise more than one coupling point between the resonant element and the acoustic radiator. The mount may comprise a combination of points and/or lines of attachment. For example, two points or small local areas of attachment may be used, one positioned near centre and one positioned at the edge of the active element. This may be useful for plate-like transducers which are generally stiff and have high natural resonance frequencies.

Alternatively only a single coupling point may be provided. This may provide the benefit, in the case of a multi-resonant element array, that the output of all the resonant elements is summed through the single mount so that it is not necessary for the output to be summed by the load, e.g. a loudspeaker radiator. Whereas such summing might be possible in a resonant panel radiator, this may not be true for a pistonic diaphragm.

The mount may be chosen to be located at an anti-node on the resonant element and may be chosen to deliver a constant average force with frequency. The mount may be positioned away from the centre of the resonant element.

The position and/or the orientation of the line of attachment may be chosen to optimise the modal density of the resonant element. The line of attachment is preferably not coincident with a line of symmetry of the resonant element. For example, for a rectangular resonant element, the line of attachment may be offset from the short axis of symmetry (or centre line) of the resonant element. The line of attachment may have an orientation which is not parallel to a symmetry axis of the acoustic radiator.

The shape of the resonant element may be selected to provide an off-centre line of attachment which is generally at the centre of mass of the resonant element. One advantage of this embodiment is that the transducer is attached at its centre of mass and thus there is no inertial imbalance. This may be achieved by an asymmetrically shaped resonant element which may be in the shape of a trapezium or trapezoid.

For a transducer comprising a beam-like or generally rectangular resonant element, the line of attachment may extend across the width of the resonant element. The area of the resonant element may be small relative to that of the acoustic radiator.

The transducer may be used to drive any structure. Thus the loudspeaker may be intendedly pistonic over at least part of its operating frequency range or may be a bending wave loudspeaker. The parameters of the acoustic radiator may be selected to enhance the distribution of modes in the resonant element in the operative frequency range.

The loudspeaker may be a resonant bending wave mode loudspeaker having an acoustic radiator and a transducer fixed to the acoustic radiator for exciting resonant bending wave modes. Such a loudspeaker is described in International Patent Application WO97/09842 and counterpart U.S. application Ser. No. 08/707,012, filed Sep. 3, 1996 (the latter now U.S. Pat. No. 6,332,029 and being incorporated herein by reference), and may be referred to as a distributed mode loudspeaker.

The acoustic radiator may be in the form of a panel. The panel may be flat and may be lightweight. The material of the acoustic radiator may be anisotropic or isotropic.

The properties of the acoustic radiator may be chosen to distribute the resonant bending wave modes substantially evenly in frequency, i.e. to smooth peaks in the frequency response caused by "bunching" or clustering of the modes. In particular, the properties of the acoustic radiator may be chosen to distribute the lower frequency resonant bending wave modes substantially evenly in frequency. The lower frequency resonant bending wave modes are preferably the ten to twenty lowest frequency resonant bending wave modes of the acoustic radiator.

The transducer location may be chosen to couple substantially evenly to the resonant bending wave modes in the acoustic radiator, in particular to lower frequency resonant bending wave modes. In other words, the transducer may be mounted at a location where the number of vibrationally active resonance anti-nodes in the acoustic radiator is relatively high and conversely the number of resonance nodes is relatively low. Any such location may be used, but the most convenient locations are the near-central locations between 38% to 62% along each of the length and width axes of the acoustic radiator, but off-centre. Specific or preferential locations are at 3/7, 4/9 or 5/13 of the distance along the axes; a different ratio for the length axis and the width axis is preferred. Preferred transducer location is 4/9 length, 3/7 width of an isotropic, rectangular panel having an aspect ratio of 1:1.13 or 1:1.41.

The operative frequency range may be over a relatively broad frequency range and may be in the audio range and/or ultrasonic range. There may also be applications for sonar and sound ranging and imaging where a wider bandwidth and/or higher possible power will be useful by virtue of distributed mode transducer operation. Thus, operation over a range greater than the range defined by a single dominant, natural resonance of the transducer may be achieved.

The lowest frequency in the operative frequency range is preferably above a predetermined lower limit which is about the fundamental resonance of the transducer.

For example, for a beam-like active resonant element, the force may be taken from the centre of the beam, and may be matched to the mode shape in the acoustic radiator to which it is attached. In this way, the action and reaction may co-operate to give a constant output with frequency. By connecting the resonant element to the acoustic radiator at an anti-node of the resonant element, the first resonance of the resonant element may appear to be a low impedance. In this way, the acoustic radiator should not amplify the resonance of the resonant element.

According to a third aspect of the invention, there is provided a microphone comprising a member capable of supporting audio input and a modal transducer as defined above coupled to the member to provide an electrical output in response to incident acoustic energy.

According to a fourth aspect of the invention, there is provided a bone conduction hearing aid comprising a modal transducer as defined above.

According to a fifth aspect of the invention, a method of making a loudspeaker comprising a resonant acoustic radiator and a modal transducer as defined above, comprises the steps of analysing the mechanical impedances of the resonant elements and the acoustic radiator, and selecting and/or adjusting the parameters of the radiator and/or the element to achieve the required modality of the resonant element and/or the radiator and to achieve a required power transfer between the element and the radiator.

According to a sixth aspect of the invention, a method of making a loudspeaker comprising a resonant acoustic radiator and a transducer as defined above, comprises the steps of analysing and/or comparing the variation of velocity and force for a given modally actuated acoustic system, and selecting a combination of values of velocity and force to achieve a chosen power transfer.

BRIEF DESCRIPTION OF THE DRAWINGS

Examples that embody the best modes for carrying out the invention are described in detail below and are diagrammatically illustrated in the accompanying drawings, in which:

FIGS. 11*a* to 11*c* are graphs of cost against $\alpha$ (frequency ratio) for a double beam transducer, a triple beam transducer and a triple disc transducer respectively;

DETAILED DESCRIPTION

Figure 1:
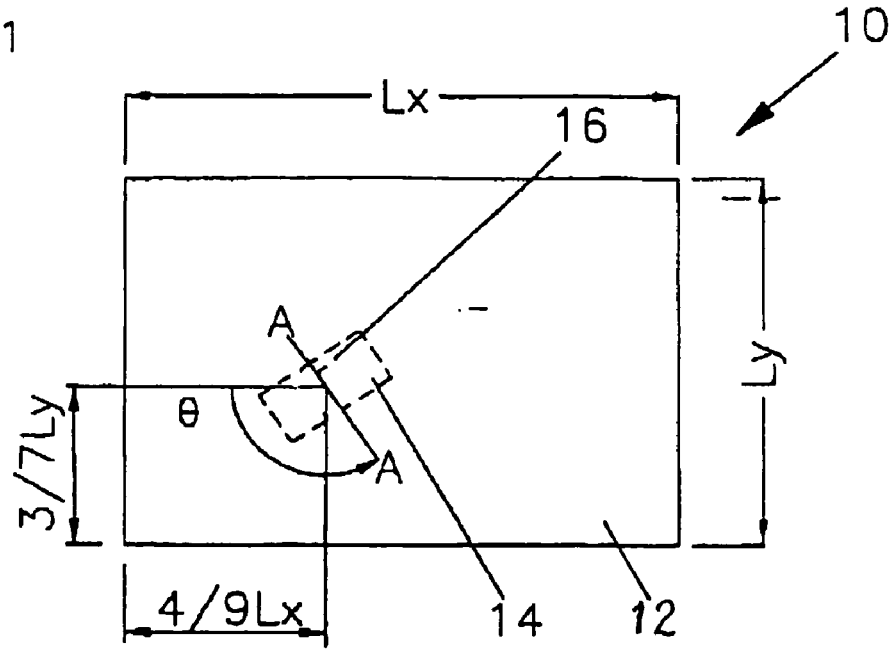
FIG. 1 is a schematic view of a panel-form loudspeaker embodying the present invention.

FIG. 1 shows a panel-form loudspeaker (10) comprising an acoustic radiator in the form of a resonant panel (12) and a transducer (14) mounted on the panel (12) to excite bending-wave vibration in the panel (12), e.g. as taught in WO97/09842 and U.S. Ser. No. 08/707,012. Resonant bending wave panel speakers as taught in WO97/09842 and U.S. Ser. No. 08/707,012 are known as DM or DML speakers. The transducer (14) is mounted off-centre on the panel on a mount (16)

at a position which is at 4/9 ths of the panel length and 3/7 ths of the panel width. This is an optimum position for applying a force to the panel as taught by WO 97/09842 and U.S. Ser. No. 08/707,012.

The transducer (14) is a pre-stressed piezoelectric actuator of the type disclosed in U.S. Pat. No. 5,632,841 (International patent application WO 96/31333) and produced by PAR Technologies Inc under the trade name NASDRIV. Thus the transducer (14) is an active resonant element.

Figure 1A:
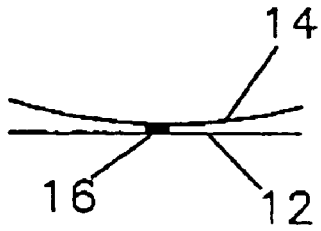
FIG. 1*a* is a section perpendicular to line A-A of FIG. 1.

As shown in FIGS. 1 and 1*a*, the transducer (14) is rectangular with out-of-plane curvature. The curvature of the transducer (14) means that the mount (16) is substantially in the form of a line of attachment. Thus the transducer (14) is attached to the panel (12) only along line A-A. The transducer is centrally mounted i.e. the line of attachment is half way along the length of the transducer along the short axis of symmetry of the transducer. The line of attachment is orientated asymmetrically at approximately 120° to the long side of the panel. Thus, the line of attachment is not parallel to the axes of symmetry of the panel.

The angle of orientation θ of the line of attachment may be chosen by modelling a centrally mounted transducer using two "measures of badness" to find the optimum angle. For example, the standard deviation of the log (dB) magnitude of the response is a measure of "roughness." Such figures of merit/badness are discussed in our International Application WO 99/41939 and counterpart U.S. application Ser. No. 09/246,967 (the latter being incorporated herein by reference).

For the modelling, the panel size is set at 524.0 mm by 462.0 mm and to simplify the model, the panel material is chosen to be optimum for the panel size. The results of the modelling show that, for a centrally mounted transducer, an angle change of 180° has no effect and that the performance of the loudspeaker is not unduly sensitive to angle. However, angles of orientation of about 90° to 120° provide an improvement since they score relatively well by both methods. Thus, the transducer (14) should be oriented up to 30° to the long side of the panel (12).

When the transducer is mounted on the panel along a line of attachment along the short axis through the centre, the resonance frequencies of the two arms of the transducer are coincident.

Figure 2:
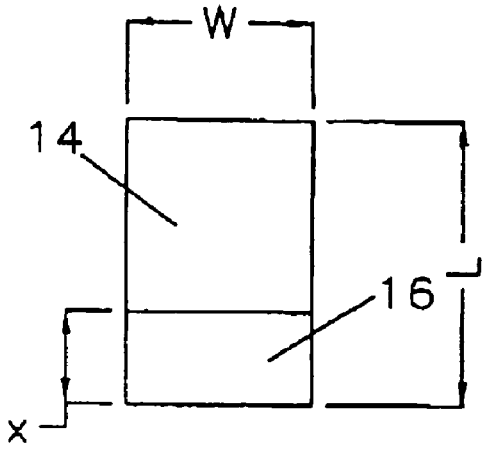
FIG. 2 is a schematic plan view of the parameterised model of a transducer according to the present invention.
Figure 2A:
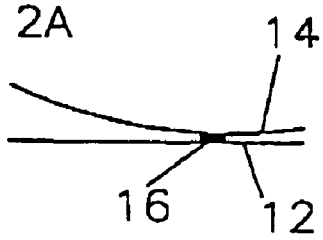
FIG. 2*a* is a section perpendicular to the line of attachment of the transducer of FIG. 2.

A parameterised model of a transducer in the form of an active resonant element is shown in FIG. 2. In the model the width (W) to length (L) ratio of the active resonant element and the position (x) of the attachment point (16) along the transducer may be varied. The active resonant element is rectangular, of length 76 mm. FIG. 2*a* illustrates the modelled transducer (14) mounted on a panel (12) along a non-central line of attachment.

Figure 3:
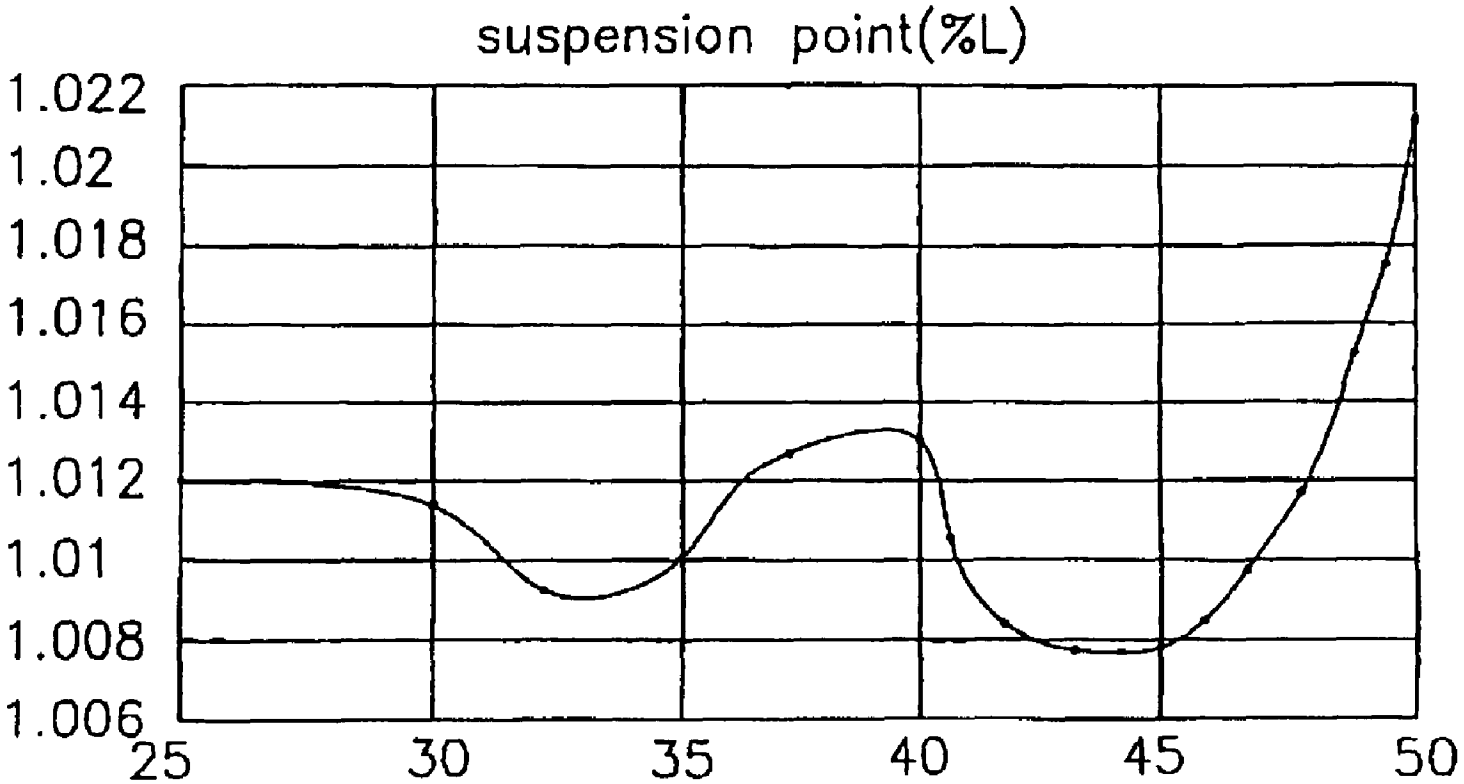
FIG. 3 is a graph of cost against suspension length (% L) for the transducer of FIG. 2.
Figure 4:
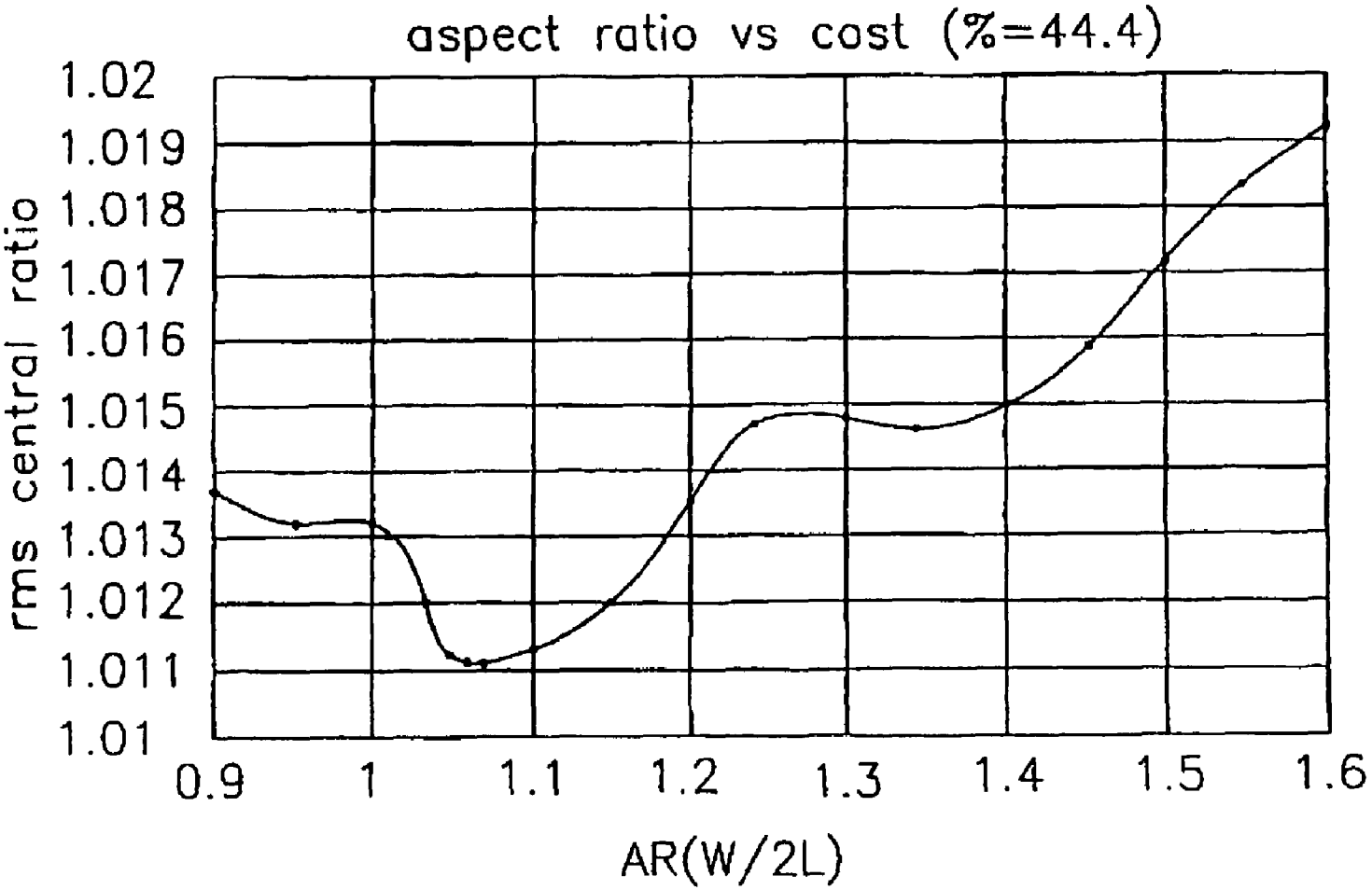
FIG. 4 is a graph of cost against aspect ratio for the transducer of FIG. 2 mounted at 44% along its length.

The results of the analysis are shown in FIGS. 3 and 4. FIG. 3 shows that optimum suspension point has the line of attachment at 43% to 44% along the length of the resonant element: the cost function (or measure of "badness") is minimised at this value; this corresponds to an estimate for the attachment point at 4/9 ths of the length. Furthermore, computer modelling showed this attachment point to be valid for a range of transducer widths. A second suspension point at 33% to 34% along the length of the resonant element also appears suitable.

FIG. 4 shows a graph of cost (or rms central ratio) against aspect ratio (AR=W/2L) for a resonant element mounted at 44% along its length. The optimum aspect ratio is 1.06+/−0.01 to 1 since the cost function is minimised at this value.

As before, the optimum angle of attachment θ to the panel (12) may be determined for an optimised transducer, namely one with aspect ratio 1.06:1 and attachment point at 44% using modelling. At an angle of 0°, the longer portion of the transducer points down. In this modified example, rotation of the line of attachment (16) will have a more marked effect since the attachment position is no longer symmetrical. There is a preference for an angle of about 270°, i.e. with the longer end facing left.

Figure 5:
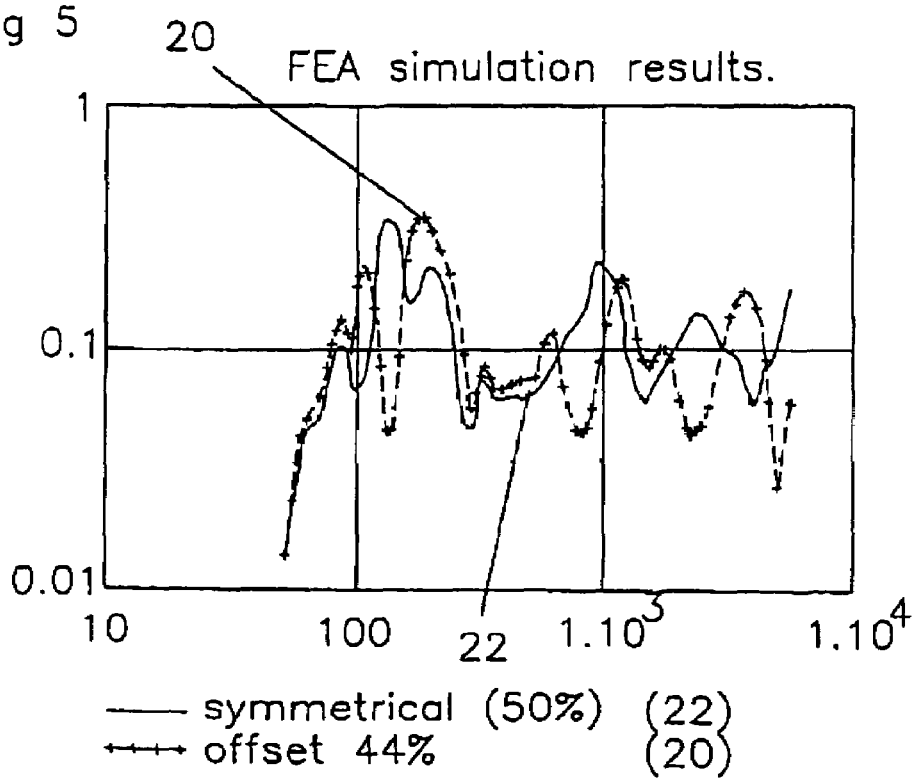
FIG. 5 is a graph of the FEA simulation of the frequency response for a panel-form loudspeaker of FIG. 1 with a transducer mounted at 44% and 50% along its length.

For completeness, the frequency response of the transducer attached at both 44% and 50% of its length was measured as shown in FIG. 5. The 44% offset shown in line (20) provides a slightly more extended bass in exchange for a few more ripples at higher frequencies than the mid-mounted transducer shown in line (22).

It seems that the increased modal density of the offset drive is compromised by the inertial imbalance caused by a position of attachment which is no longer at the centre of mass of the rectangular transducer. Accordingly, investigations were made to see whether the inherent imbalance could be improved without losing the improved modality.

Figure 6A:
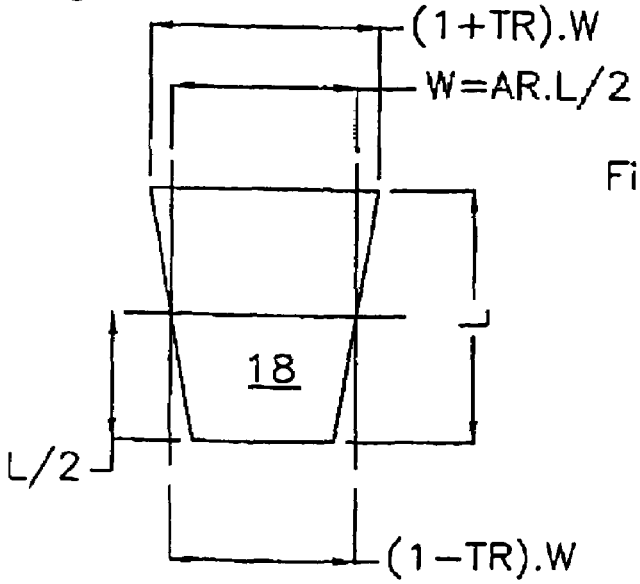
FIGS. 6*a* and 6*b* are schematic plan views of a transducer according to another aspect of the invention.
Figure 6B:
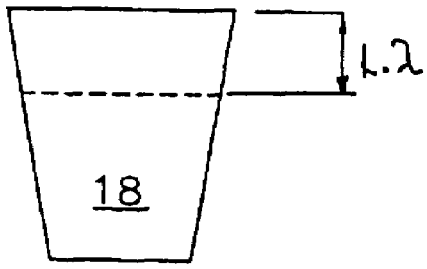

FIGS. 6*a* and 6*b* show a second example, namely an asymmetrically shaped transducer (18) in the form of a resonant element having a trapezoid-shaped cross-section. The shape of a trapezoid is controlled by two parameters, AR (aspect ratio) and TR (taper ratio). AR and TR determine a third parameter, X, such that some constraint is satisfied—for example, equal mass on either side of the line.

The constraint equation for equal mass (or equal area) is as follows:

$$\int_0^{\lambda}\left(1+2TR\left(\frac{1}{2}-\xi\right)\right)d\xi=\int_{\lambda}^{1}\left(1+2TR\left(\frac{1}{2}-\xi\right)\right)d\xi$$

The above may readily be solved for either TR or λ as the dependent variable, to give:

$$TR=\frac{1-2\lambda}{2\lambda(1-\lambda)}\text{ or }\lambda=\frac{1+TR-\sqrt{1+TR^2}}{2TR}\approx\frac{1}{2}-\frac{TR}{4}$$

Equivalent expressions are readily obtained for equalising the moments of inertia, or for minimising the total moment of inertia. The constraint equation for equal moment of inertia (or equal $2^{nd}$ moment of area) is as follows:

$$\int_0^{\lambda}\left(1+2TR\left(\frac{1}{2}-\xi\right)\right)(\lambda-\xi)^2d\xi=\int_{\lambda}^{1}\left(1+2TR\left(\frac{1}{2}-\xi\right)\right)(\xi-\lambda)^2d\xi$$

$$TR=\frac{(\lambda^2-\lambda+1)(2\lambda-1)}{2\lambda^4-4\lambda^3+2\lambda-1}\text{ or }\lambda\approx\frac{1}{2}-\frac{TR}{8}$$

The constraint equation for minimum total moment of inertia is:

$$\frac{d}{d\lambda}\left(\int_0^{1}\left(1+2TR\left(\frac{1}{2}-\xi\right)\right)(\lambda-\xi)^2d\xi\right)=0$$

$$TR=3-6\lambda\text{ or }\lambda=\frac{1}{2}-\frac{TR}{6}$$

A cost function (measure of "badness") was plotted for the results of 40 FEA runs with AR ranging from 0.9 to 1.25, and TR ranging from 0.1 to 0.5, with λ constrained for equal mass. The transducer is thus mounted at the centre of mass. The results are tabulated below and are plotted in FIG. 7 which shows the cost function against AR and TR.

| tr | λ | 0.9 | 0.95 | 1 | 1.05 | 1.1 | 1.15 | 1.2 | 1.25 |
|---|---|---|---|---|---|---|---|---|---|
| 0.1 | 47.51% | 2.24% | 2.16% | 2.16% | 2.24% | 2.31% | 2.19% | 2.22% | 2.34% |
| 0.2 | 45.05% | 1.59% | 1.61% | 1.56% | 1.57% | 1.50% | 1.53% | 1.66% | 1.85% |
| 0.3 | 42.66% | 1.47% | 1.30% | 1.18% | 1.21% | 1.23% | 1.29% | 1.43% | 1.59% |
| 0.4 | 40.37% | 1.32% | 1.23% | 1.24% | 1.29% | 1.25% | 1.29% | 1.38% | 1.50% |
| 0.5 | 38.20% | 1.48% | 1.44% | 1.48% | 1.54% | 1.56% | 1.58% | 1.60% | 1.76% |

Figure 7:
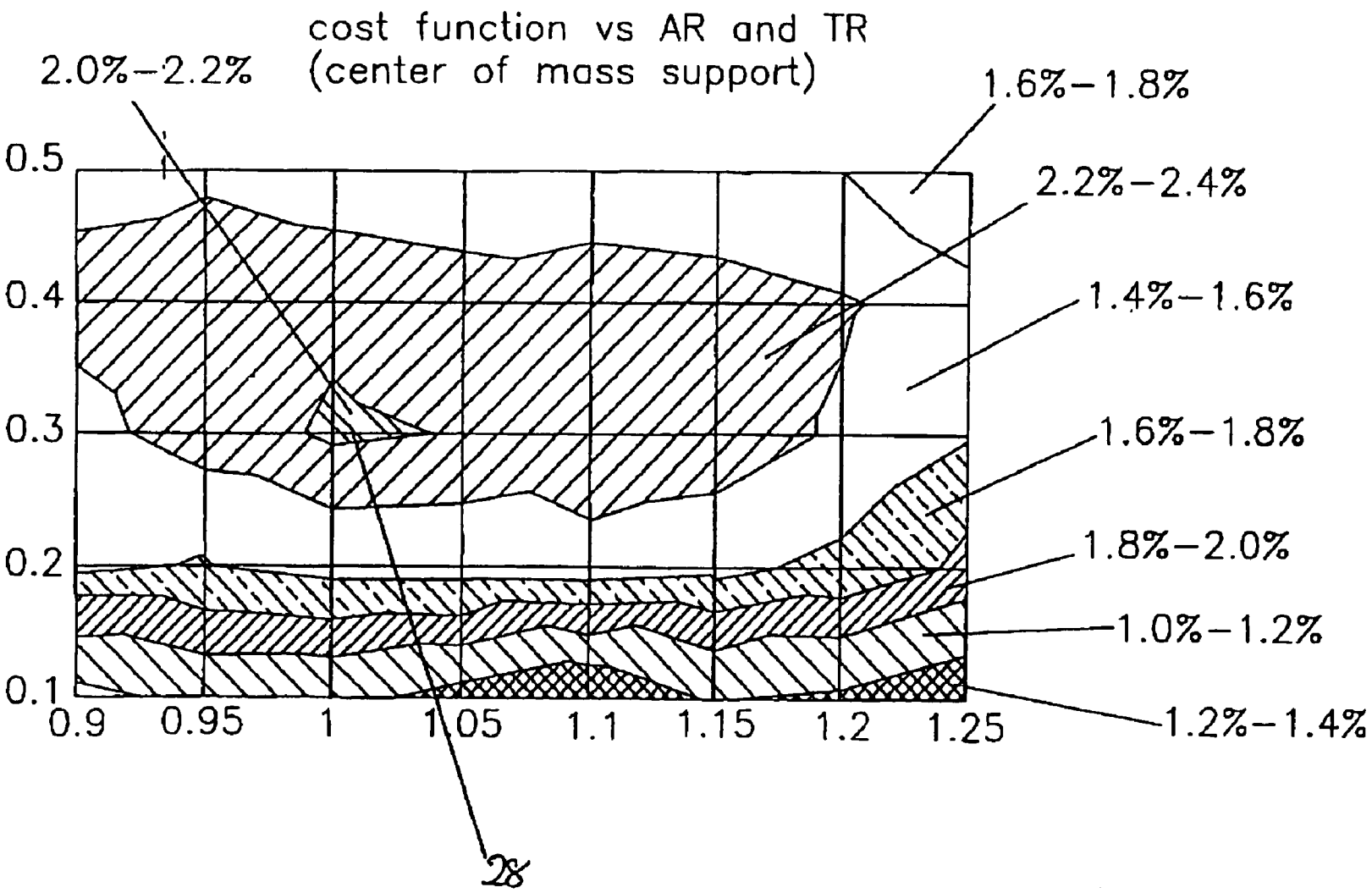
FIG. 7 is a plot of the cost function against AR and TR for the transducer of FIGS. 6*a* and 6*b;*

FIG. 7 and the tabulated results show that there is an optimum shape (labelled at point 28 in FIG. 7) with AR=1 and TR=0.3, giving λ at close to 43%. One advantage of a trapezoidal transducer is thus that the transducer may be mounted along a line of attachment which is at its centre of gravity/mass but is not a line of symmetry. Such a transducer would thus have the advantages of improved modal distribution, without being inertially unbalanced.

Accordingly, a model of the optimised trapezoidal transducer was applied to the same panel model as in above, in order to find the best orientation. Thus, as above, the panel size is set at 524.0 mm by 462.0 mm and the panel material is chosen to be optimum for the panel size. The two methods of comparison used previously again select 270° to 300° as the optimum angle of orientation.

An alternative way of optimising the modality of a transducer is to use a transducer comprising two active elements, e.g. two coincident piezoelectric beams. A beam has a set of modes, starting from a fundamental mode, which are defined by the geometry and the material properties of the beam. The modes are quite widely spaced and limit the fidelity of a loudspeaker using the transducer above resonance. Thus, a second beam is selected with a distribution of modes which are interleaved in frequency with the modal distribution of the first beam.

By interleaving the distribution, the overall output of the transducer may be optimised. The criterion for optimality is chosen to be appropriate to the task in hand. For example, if the pass-band for the two beam transducer is only up to the $2^{nd}$ order modes, it is not sensible to optimise the interleaving of the first ten modes, as this may prejudice the optimality of the first 3 or 4 modes.

Considering as an example a first piezoelectric bi-morph 36 mm long by 12 mm wide and 350 microns thick overall which has a fundamental bending resonance at around 960 Hz. The first modes are given in table 1.

TABLE 1

| No. | Frequency (Hz) |
|---|---|
| 1 | 957 |
| 2 | 2460 |
| 3 | 5169 |
| 4 | 8530 |

Figure 8:
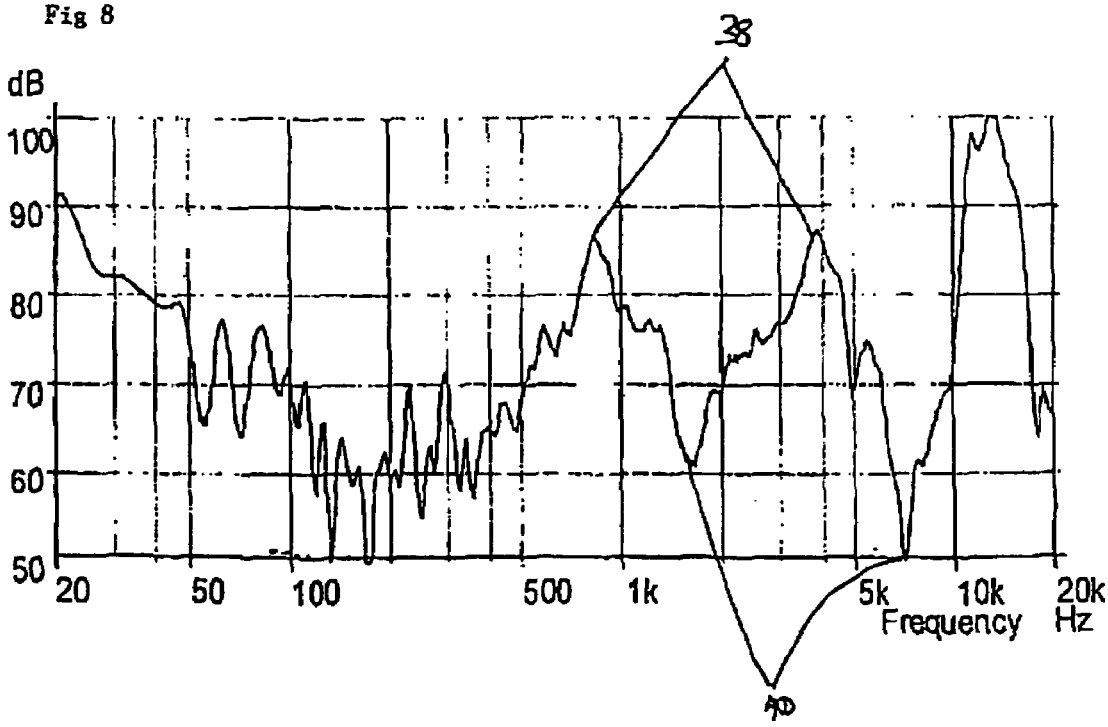
FIG. 8 is a frequency response for a single piezoelectric beam transducer.

The first transducer was mounted on a small panel and the frequency response is plotted in FIG. 8. There are strong outputs (38) at 830 Hz and 3880 Hz, with dips (40) at 1.6 kHz and 7.15 kHz. The frequencies of the resonances are lower than predicted, probably because of the difficulty in accurately predicting the mechanical properties of the piezoelectric material.

The response has too many broad dips to be useable since there is a need to boost the output in the regions around the dips (40). Thus a beam with a complementary set of frequencies, namely a set which produce a frequency response with peaks where there are dips for the first transducer, would be ideal.

A shorter piezoelectric element will have a higher fundamental resonance. The modes for such a 28 mm long beam are shown in table 2 below;

TABLE 2

| No. | Frequency (Hz) |
|---|---|
| 1 | 1584 |
| 2 | 4361 |
| 3 | 8531 |
| 4 | 14062 |

Figure 9:
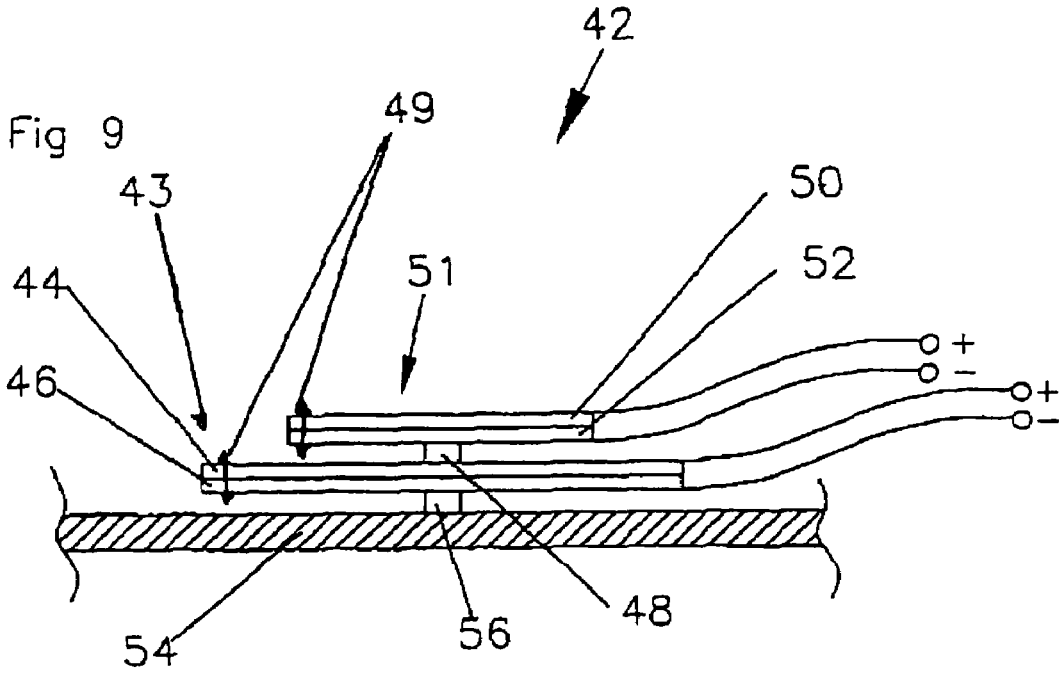
FIG. 9 is a side elevational view of a double beam transducer according to an embodiment of the invention.

The two beams may be combined to form a double beam transducer (42) as shown in FIG. 9. The transducer (42) comprises a first piezoelectric beam (43) on the back of which is mounted a second piezoelectric beam (51) by a link in the form of a stub (48) located at the centre of both beams. Each beam is a bi-morph. The first beam (43) comprises two layers (44,46) of different piezoelectric material and the second beam (51) comprises two layers (50,52). The poling directions of each layer of piezoelectric material are shown by arrows (49). Each layer (44, 50) has an opposite poling direction to the other layer (46, 52) in the bi-morph.

The first piezoelectric beam (44,46) is mounted on a structure (54), e.g. a bending-wave loudspeaker panel, by a mount in the form of a stub (56) located at the centre of the first beam. The beams could be used on either side of a DML panel, possibly in different locations.

By mounting the first beam at its centre only the even order modes will produce output. By locating the second beam behind the first beam, and coupling both beams centrally by way of a stub they can both be considered to be driving the same axially aligned or coincident position.

Figure 10:
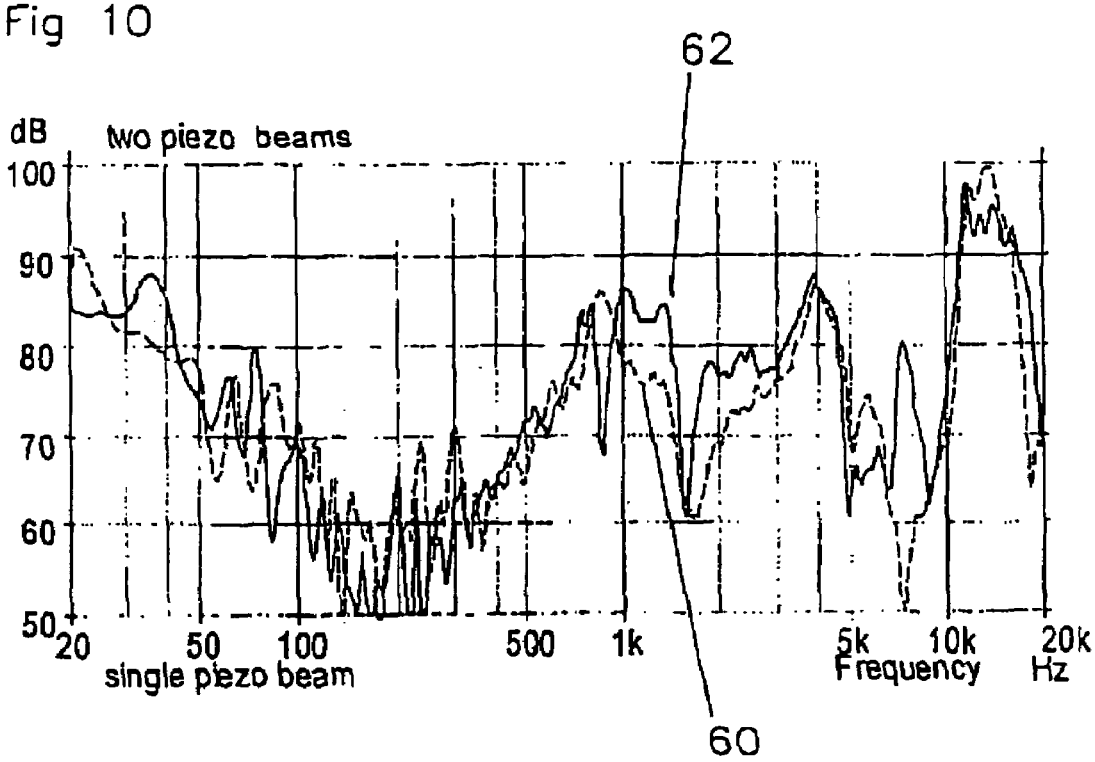
FIG. 10 is a graph showing the frequency response of the transducers of FIG. 8 and FIG. 9.

When elements are joined together, the resulting distribution of modes is not the sum of the separate sets of frequencies, because each element modifies the modes of the other. The frequency in FIG. 10 shows the difference between a transducer comprising a single beam (60), and one comprising two beams used together (62). The two beams are designed so that their individual modal distributions are interleaved to enhance the overall modality of the transducer. The two beams add together to produce a useable output over a frequency range of interest. Local narrow dips occur because of the interaction between the piezoelectric beams at their individual even order modes.

The second beam may be chosen by using the ratio of the fundamental resonance of the two beams. If the materials and thicknesses are identical, then the ratio of frequencies is just the square of the ratio of lengths. If the higher f0 (fundamental frequency) is simply placed half way between f0 and f1 of the other, larger beam, f3 of the smaller beam and f4 of the lower beam coincide.

Figure 11A:
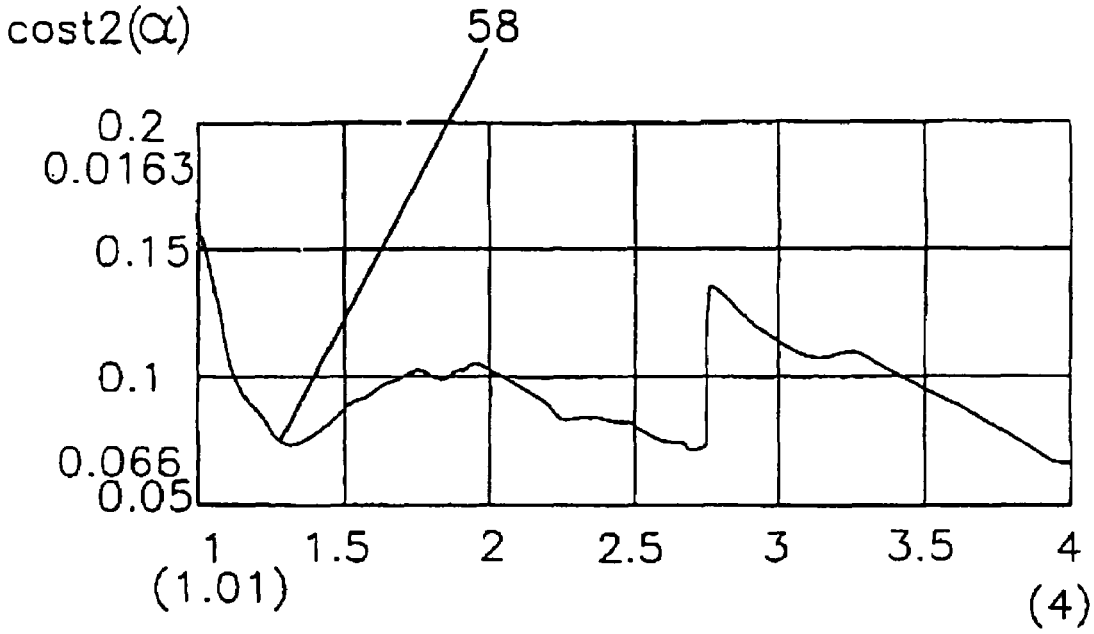

FIG. 11*a* shows a graph of a cost function against ratio of frequency for two beams which shows that the ideal ratio is 1.27:1, namely where the cost function is minimised at point (58). This ratio is equivalent to the "golden" aspect ratio (ratio of f0:f20) described in WO97/09482 and U.S. Ser. No. 08/707,012.

Figure 11B:
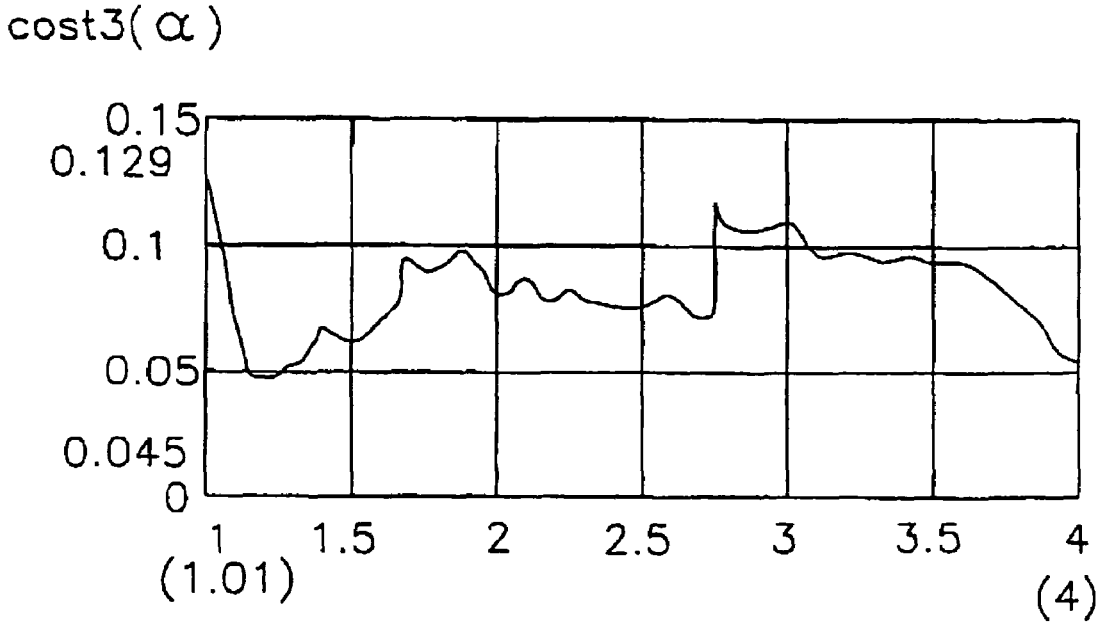
Figure 11A:
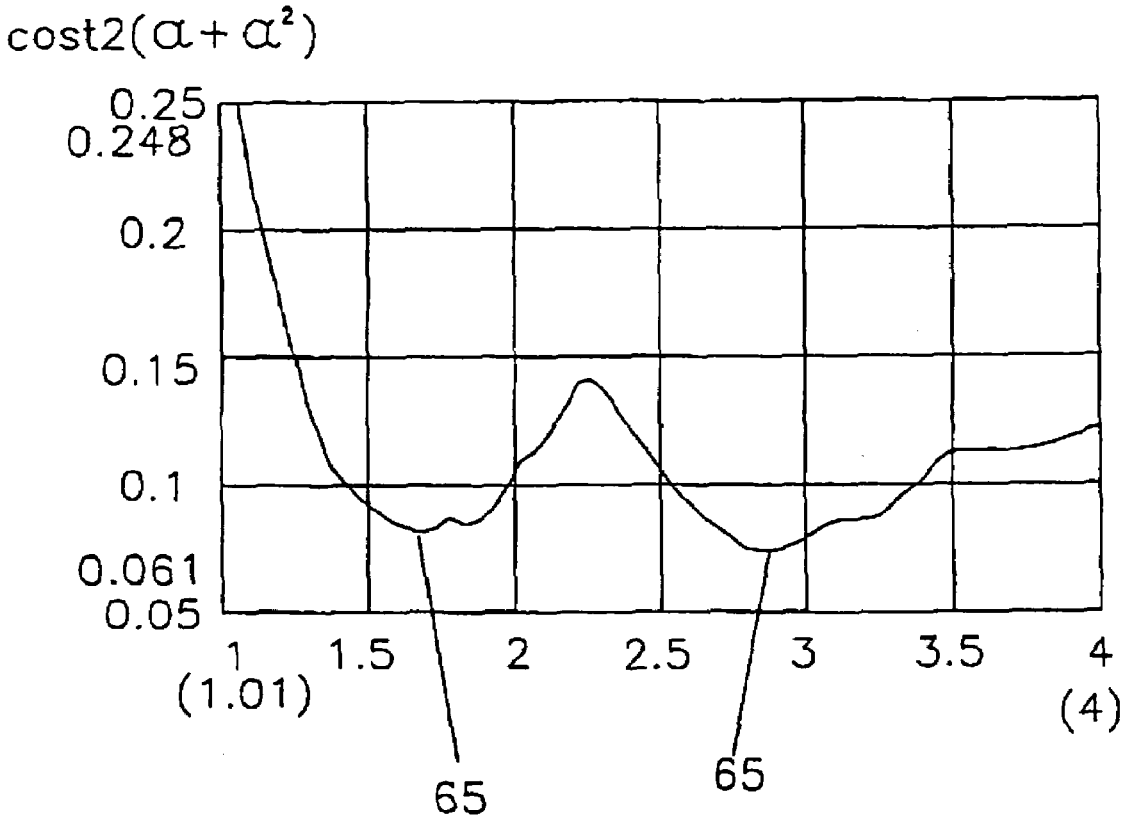

The method of improving the modality of a transducer may be extended by using three piezoelectric beams in the transducer. FIG. 11*b* shows a section of a graph of a cost function against ratio of frequency for three beams. The ideal ratio is 1.315:1.147:1.

The method of combining active elements, e.g. beams, may be extended to using piezoelectric discs. Using two discs, the ratio of sizes of the two discs depends upon how many modes are taken into consideration. For high order modal density, a ratio of fundamental frequencies of about 1.1+/−0.02 to 1 may give good results. For low order modal density (i.e. the first few or first five modes), a ratio of fundamental frequencies of about 3.2:1 is good. The first gap comes between the second and third modes of the larger disc.

Since there is a large gap between the first and second radial modes in each disc, much better interleaving is achieved with three rather than with two discs. When adding a third disc to the double disc transducer, the plausible first target is to plug the gap between the second and third modes of the larger disc of the previous case. However, geometric progression shows that this is not the only solution. Using fundamental frequencies of f0, $\alpha$.f0 and $\alpha^2$.f0, and plotting rms ($\alpha$,$\alpha^2$) (root mean square) in FIG. 11*c*, there exist two principal optima for $\alpha$. The values are about 1.72 and 2.90, the two minima (65) on the graph, the latter value corresponding to the plausible gap-filling method.

Using fundamental frequencies of f0, $\alpha$.f0 and $\beta$.f0 so that both scalings are free and using the above values of $\alpha$ as seed values, slightly better optima are achieved. The parameter pairs ($\alpha$,$\beta$) are (1.63, 3.03) and (3.20, 8.19). These optima are quite shallow, meaning that variations of 10%, or even 20%, in the parameter values are acceptable.

Figure 11D:
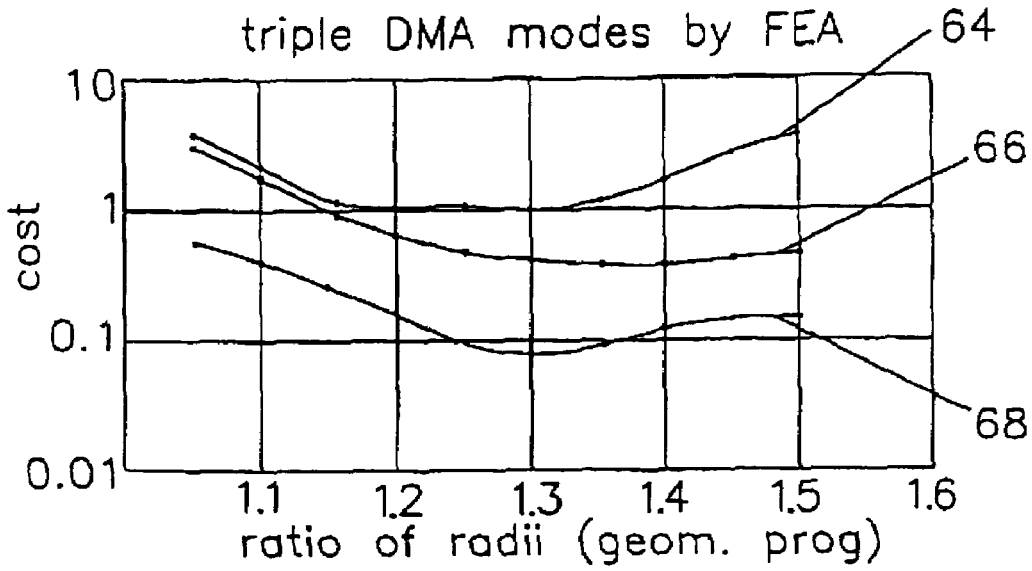
FIG. 11*d* is a graph of cost against ratio of radii for a triple disc transducer according to another aspect of the invention.

An alternative approach for determining the different discs to be combined is to consider the cost as a function of the ratio of the radii of the three discs. FIG. 11*d* shows the results of FEA analysis plotting three different cost functions against ratio of radii. In FIG. 11*d*, the three discs are coupled together although it is noted that analysing the three discs in isolation produces similar results.

The three cost functions are RSCD (ratio of sum of central differences), SRCD (sum of the ratio of central differences) and SCR (sum of central ratios) shown by lines (64), (66) and (68) respectively. For a set of modal frequencies, $f_0$, $f_1$, $f_n$, . . . $f_N$, these functions are defined as:

RSCD (R sum CD):

RSCD (R sum CD):

$$RSCD = \frac{\frac{1}{N-1}\sum_{n=1}^{N-1}(f_{n+1} + f_{n-1} - 2f_n)^2}{f_0}$$

SRCD (sum RCD):

$$SRCD = \frac{1}{N-1}\sum_{n=1}^{N-1}\left(\frac{f_{n+1} + f_{n-1} - 2f_n}{f_n}\right)^2$$

-continued

CR:

$$SCR = \frac{1}{N-1}\sum_{n=1}^{N-1}\left(\frac{f_{n+1} \cdot f_{n-1}}{(f_n)^2}\right)$$

The optimum radii ratio, i.e. where the cost function is minimised, is 1.3 in all three lines in FIG. 11*d*. Since the square of the radii ratio is equal to the frequency ratio, for these identical material and thickness discs, the results of 1.3*1.3=1.69 and the analytical result of 1.67 are in good agreement.

Figure 12A:
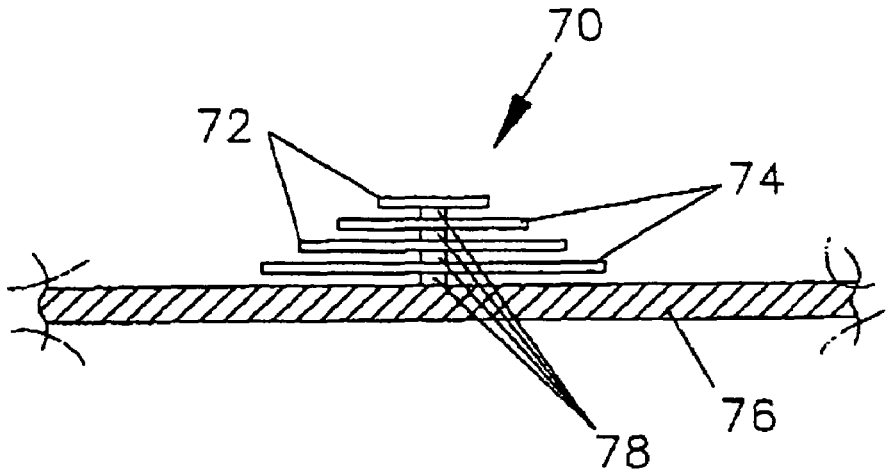
FIG. 12*a* is a side elevational view of a multiple element transducer according to another aspect of the invention.
Figure 12B:
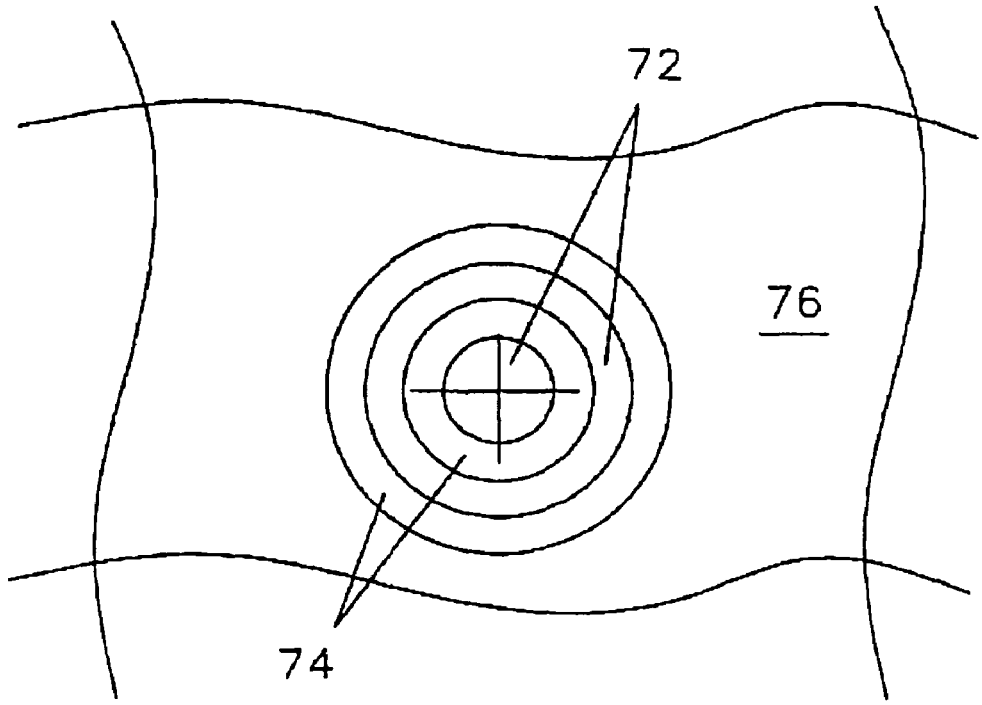
FIG. 12*b* is a plan view of the transducer of FIG. 12*a;*

Alternatively or additionally, passive elements may be incorporated into the transducer to improve its overall modality. The active and passive elements may be arranged in a cascade. FIGS. 12*a* and 12*b* show a multiple disc transducer (70) comprising two active piezoelectric elements (72) stacked with two passive resonant elements (74), e.g. thin metal plates so that the modes of the active and passive elements are interleaved. The elements are connected by links in the form of stubs (78) located at the centre of each active and passive element. The elements are arranged concentrically. Each element has different dimensions with the smallest and largest discs located at the top and bottom of the stack, respectively. The transducer (70) is mounted on a load device (76), e.g. a panel, by a mount in the form of a stub (78) located at the centre of the first passive device which is the largest disc.

Figure 13:
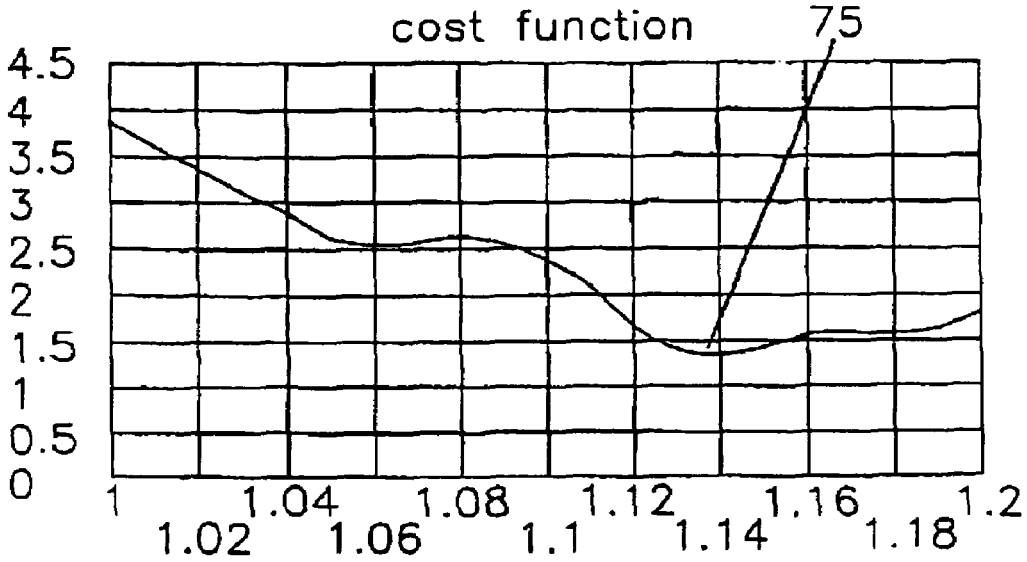
FIG. 13 is a graph of cost function against aspect ratio for a transducer comprising two plates.

The method of improving the modality of a transducer may be extended to a transducer comprising two active elements in the form of piezoelectric plates. Two plates of dimensions (1 by $\alpha$) and ($\alpha$ by $\alpha^2$) are coupled at (3/7, 4/9). FIG. 13 shows a graph of cost function against aspect ratio ($\alpha$) and the optimal value (75) for a is 1.14. The frequency ratio is therefore about 1.3:1 (1.14×1.14=1.2996).

Figure 14:
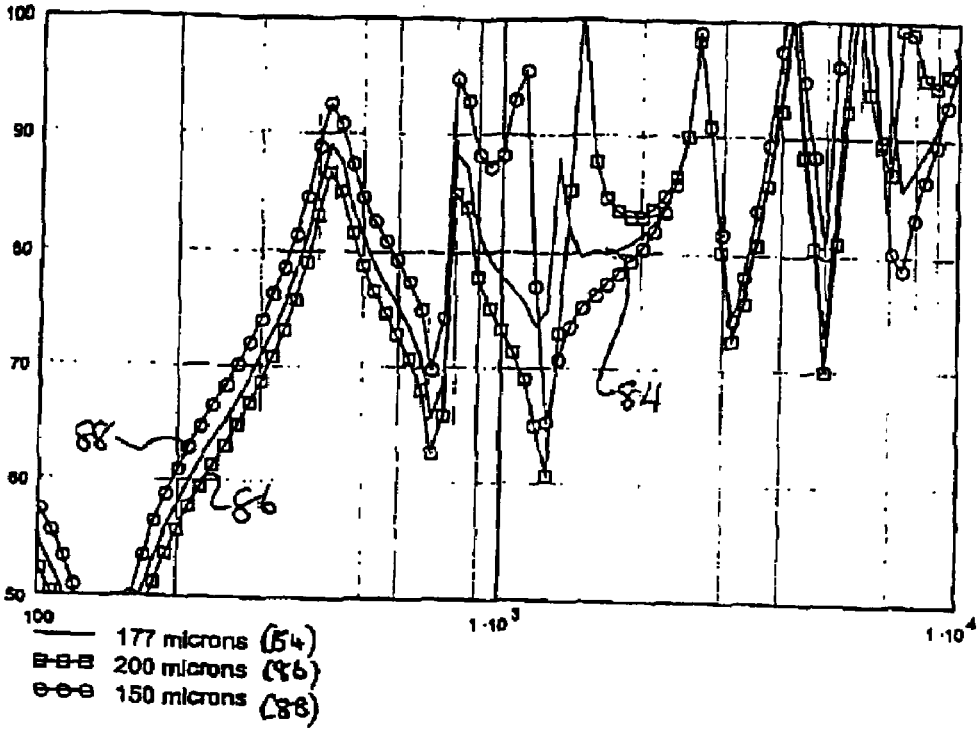
FIG. 14 is a frequency response (sound pressure (dB) against frequency (Hz)) for three transducers of different thickness mounted on a panel.
Figure 15:
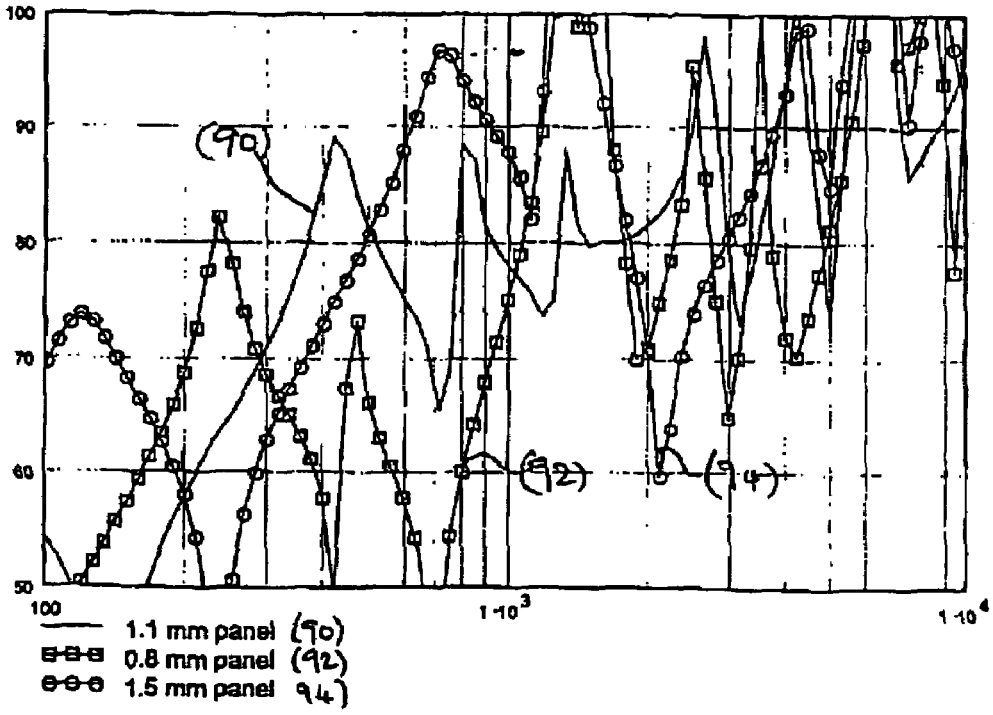
FIG. 15 is a frequency response (sound pressure (dB) against frequency (Hz)) for a transducer according to the present invention mounted on three different panels.

In addition or as an alternative to altering the modal characteristics of the transducer, the parameters of the object, e.g. panel, on which the transducer is mounted may be altered to match the modality of the transducer. For example, considering a transducer in the form of an active resonant element mounted on a panel, FIGS. 14 and 15 show how the frequency response differs with thickness of the transducer and thickness of panel respectively. The active element is in the form of a piezoelectric beam. FIG. 14 has three frequency responses (84), (86), (88) for a 177 micron, a 200 micron and a 150 micron beam respectively. FIG. 15 has three frequency responses (90), (92), (94) for a 1.1 mm, a 0.8 mm and a 1.5 mm thick panel respectively.

FIGS. 14 and 15 show that the frequency response for a 1.1 mm panel matches the frequency response for a 177 micron thick beam. Hence, the modality of a 1.1 mm panel matches that of a 177 micron beam.

Figure 16:
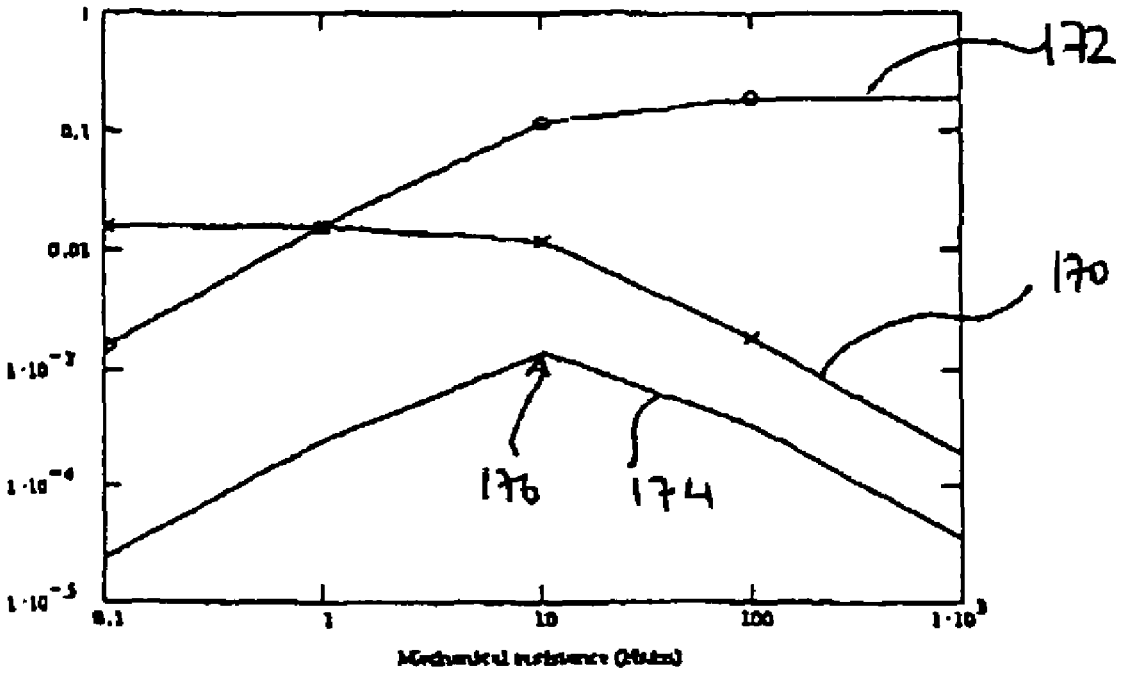
FIG. 16 is a graph of force, velocity and power against varying load.

Although the transducer is modal, a mean force and velocity may be estimated for any load or panel impedance. The maximum mechanical power is available when the product of the force and the velocity is at a maximum. The transducer may be used to drive any load and the optimal load value may be found by plotting the velocity (170), the force (172) and the mechanical power (174) against load resistance as shown in FIG. 16. The maximum power (176) occurs when the load resistance is approximately 12 Ns/m; for a lower load resistance, the velocity will increase and the force decrease, and for higher load resistance, the velocity will decrease and the force increase.

Figure 17:
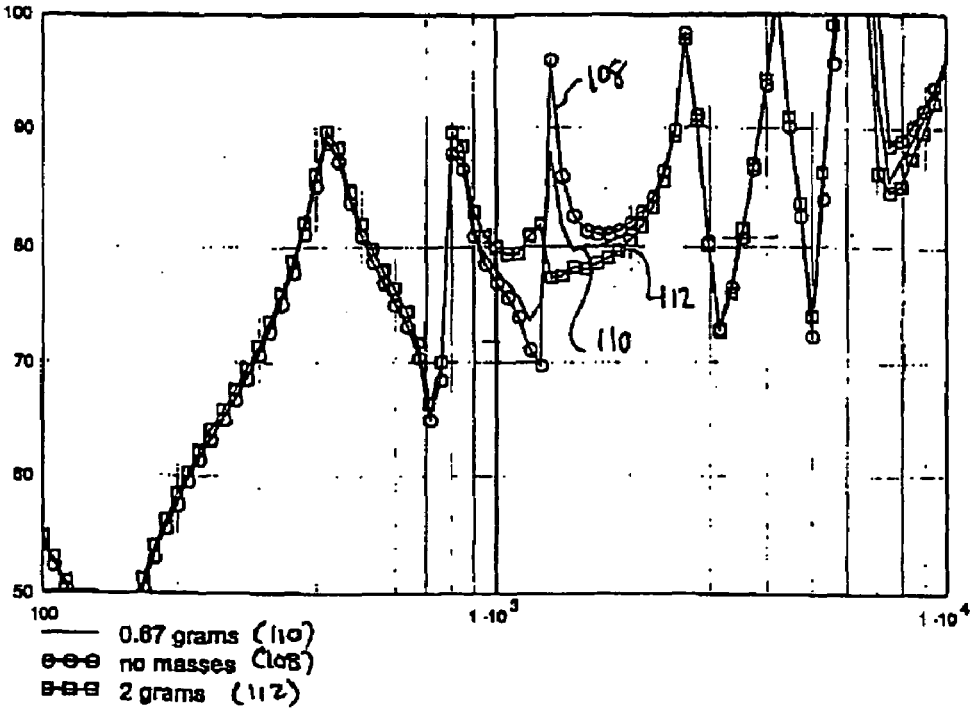
FIG. 17 is a frequency response for a transducer according to the present invention mounted on a panel with/without added damping masses.
Figure 18:
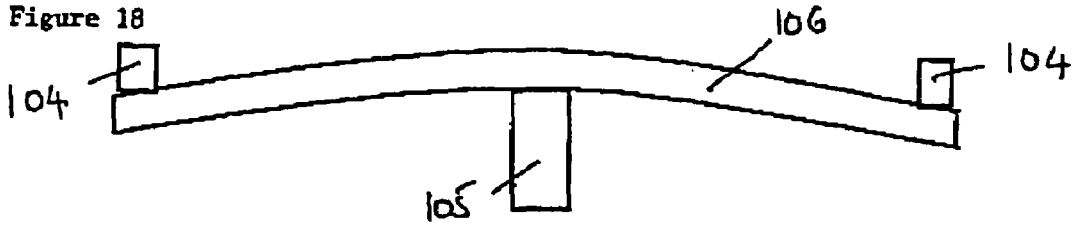
FIG. 18 is a side elevational view of a transducer according to FIG. 17.

FIG. 17 shows the results of adding small masses (104) at the end of the piezoelectric transducer (106) having a mount (105) as shown in FIG. 18. In FIG. 17 there are shown the frequency responses (108, 110 and 112) for a transducer with no mass, a beam with two 0.67 g masses and a transducer with two 2 g masses respectively. A beam with two 2 g masses is ideally matched since the frequency response (110) has less variation in the mid range (1 kHz to 5 kHz) than the frequency responses (108, 112) for no masses or 0.67 g masses.

Figure 19:
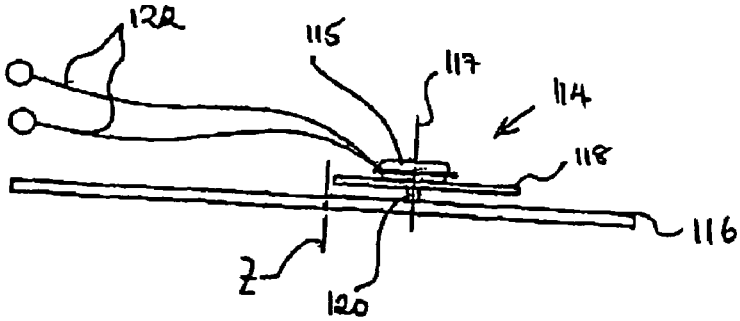
FIG. 19 is a side elevational view of a transducer according to another aspect of the invention.
Figure 20:
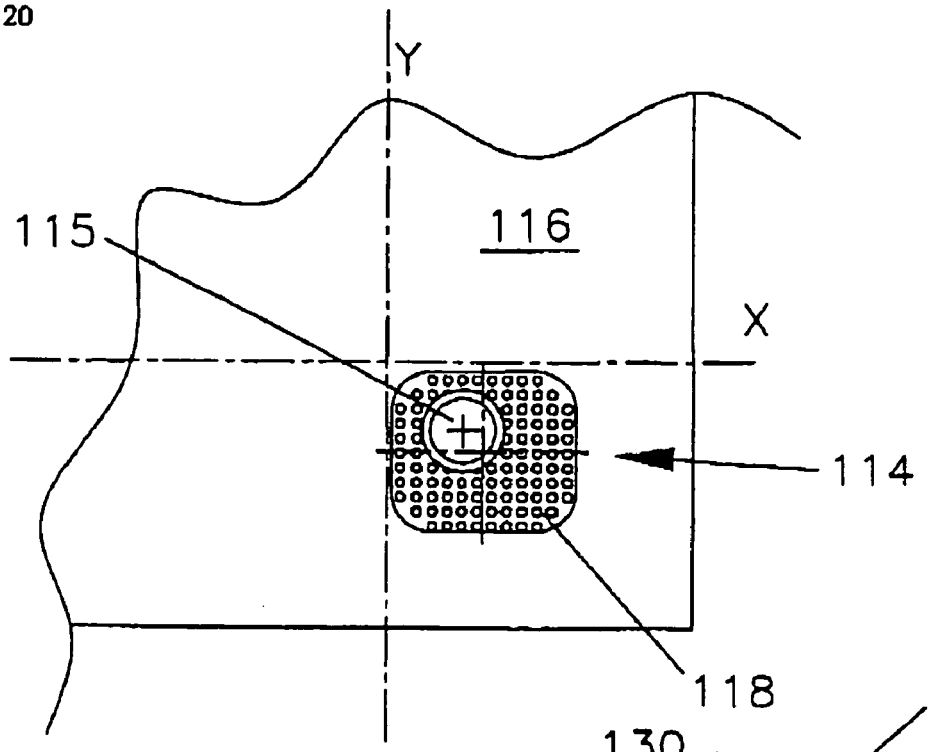
FIG. 20 is a plan view of the transducer of FIG. 19.

In FIGS. 19 and 20 the transducer (114) is an inertial electrodynamic moving coil exciter, e.g. as described in WO97/09842 and U.S. Ser. No. 08/707,012, having a voice coil forming an active element (115) and a passive resonant element in the form of a modal plate (118). The active element (115) is mounted on the modal plate (118) and off-centre of the modal plate. The modal plate (118) is mounted on the panel (116) by a coupler (120). The coupler is aligned with the axis (117) of the active element (115) but not with the axis (Z) normal to the plane of the panel (116). Thus the transducer is not coincident with the normal axis (Z). The active element is connected to an electrical signal input via electrical wires (122).

As shown in FIG. 20, the modal plate (118) is perforate to reduce the acoustic radiation therefrom. The active element is located off-centre of the modal plate (118), for example, at the optimum mounting position, i.e. (3/7, 4/9). Moreover, the transducer (114) is mounted off-centre on the panel (116), also for example, at the optimum mounting position, i.e. (3/7, 4/9). The transducer (114) is thus not coincident with either of the two normal axes (X,Y) which are in the plane of the panel (116).

Figure 21A:
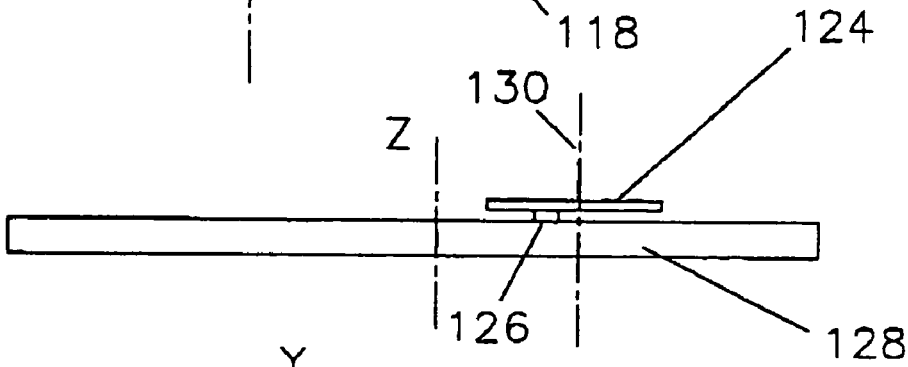
FIGS. 21*a* and 21*b* are respective side elevational and plan views of a transducer according to another aspect of the invention.
Figure 21B:
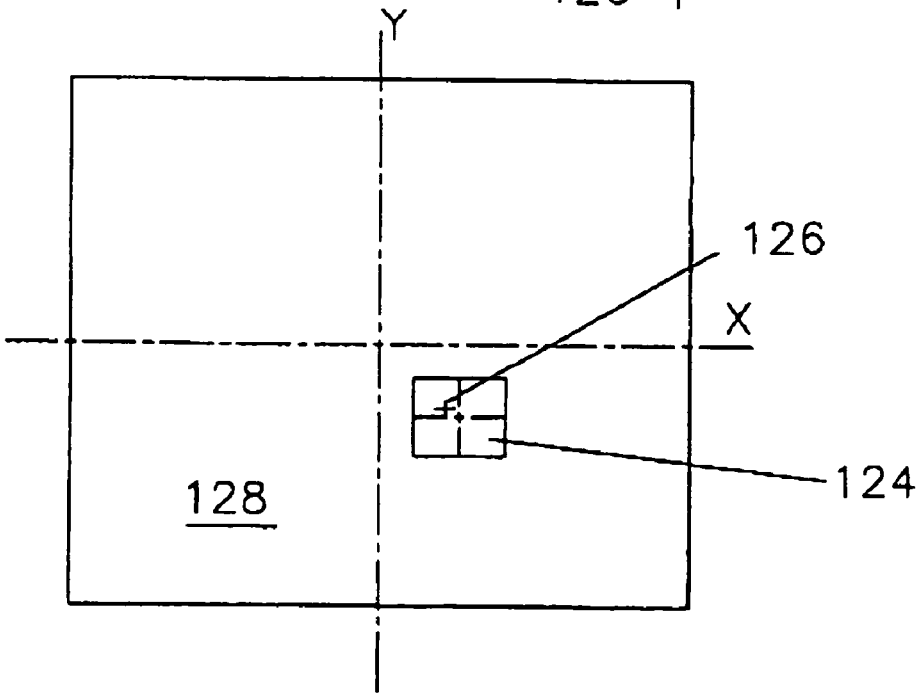

FIGS. 21*a* and 21*b* show a transducer (124) comprising an active piezoelectric resonant element which is mounted by a mount (126) in the form of a stub to a panel (128). Both the transducer (124) and the panel (128) have ratios of width to length of 1:1.13. The mount (126) is not aligned with any axes (130, X,Y,Z) of the transducer or the panel. Furthermore, the placement of the mount (126) is at the optimum position off-centre with respect to both the transducer (124) and the panel (128).

Figure 22:
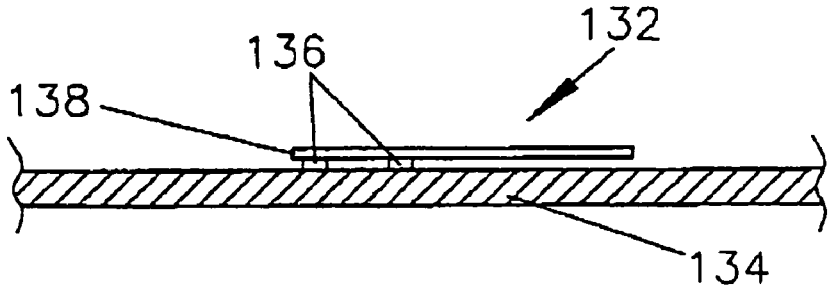
FIG. 22 is a side elevational view of a transducer according to another aspect of the invention.

FIG. 22 shows a transducer (132) comprising an active piezoelectric resonant element in the form of a beam. The transducer (132) is coupled to a panel (134) by two mounts (136) in the form of stubs. One stub is located towards an end (138) of the beam and the other stub is located towards the centre of the beam.

Figure 23:
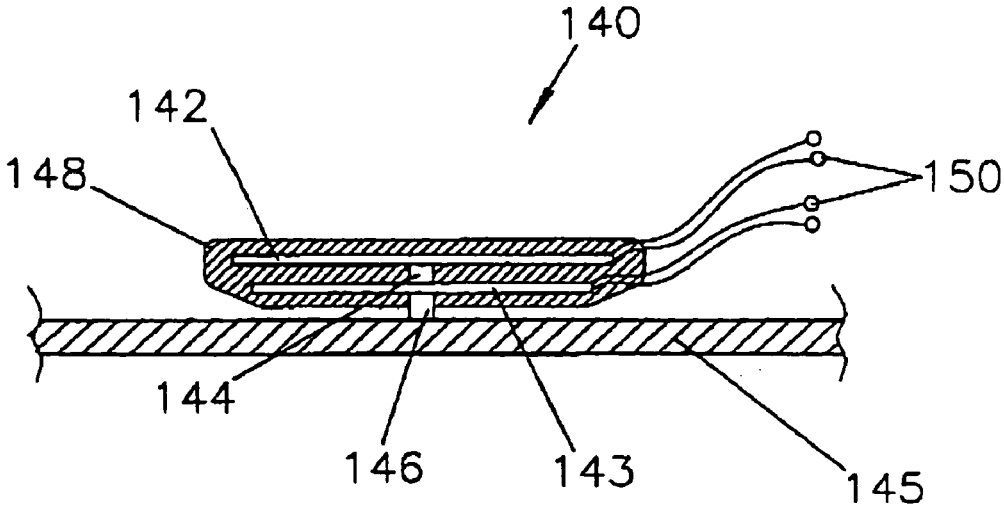
FIG. 23 is a side elevational view of an encapsulated transducer according to another aspect of the invention.

FIG. 23 shows a transducer (140) comprising two active resonant elements (142,143) coupled by a link (144) and an enclosure (148) which surrounds the link (144) and the resonant elements (142). The transducer is thus made shock and impact resistant. The enclosure is made of a low mechanical impedance rubber or comparable polymer so as not to impede the transducer operation. If the polymer is water resistant, the transducer (140) may be made waterproof.

The upper resonant element (142) is larger than the lower resonant element (143) which is coupled to a panel (145) via a mount in the form of a stub (146). The stub is located at the centre of the lower resonant element (143). The power couplings (150) for each active element extend from the enclosure to allow good audio attachment to a load device (not shown).

Figure 24:
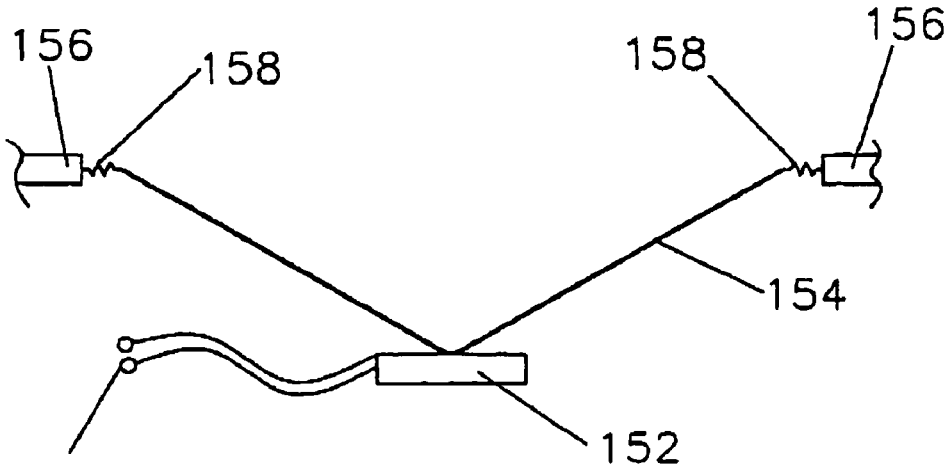
FIG. 24 is a side elevational view of a transducer according to the invention mounted on the cone of a pistonic loudspeaker.

FIG. 24 shows a transducer (152) according to the invention applying a force to a diaphragm for a pistonic loudspeaker. The diaphragm is in the shape of a cone (154) having an apex to which the transducer is mounted. The cone (154) is supported in a baffle (156) by a resilient termination (158).

Figure 25A:
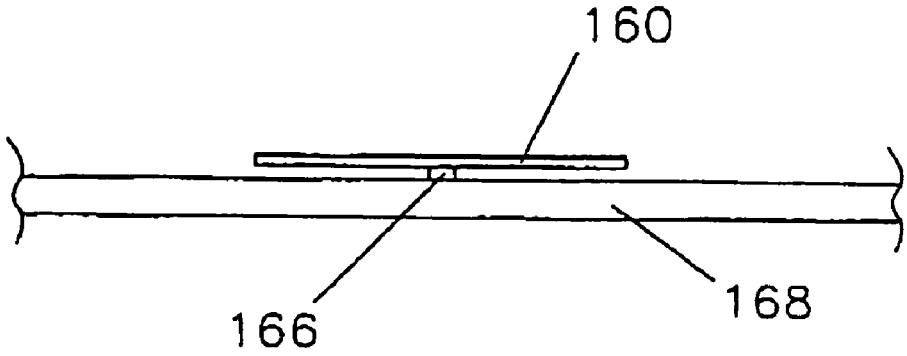
FIGS. 25*a* and 25*b* are respective side elevational and plan views of a transducer according to another aspect of the invention.
Figure 25B:
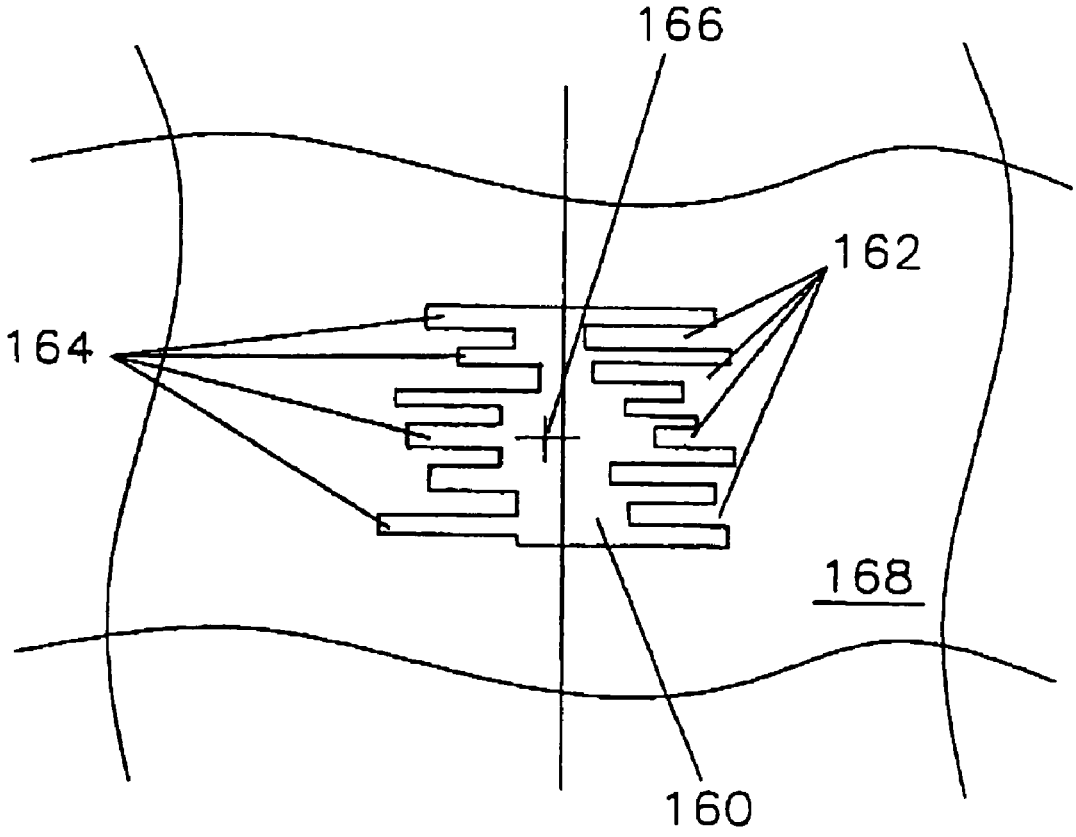

FIGS. 25*a* and 25*b* show a transducer (160) in the form of an plate-like active resonant element. The resonant element is formed with slots (162) which define fingers (164) and thus form a multi-resonant system. The resonant element is mounted on a panel (168) by a mount in the form of a stub (166).

The present invention may be seen as the reciprocal of a distributed mode panel, e.g. as described in WO97/09842 and U.S. Ser. No. 08/707,012, in that the transducer is designed to be a distributed mode object. Moreover, the force from the transducer is taken from a point that would normally be used as the distributed mode drive point (e.g. optimum location (3/7,4/9).

The invention thus provides a transducer having an improved performance and a loudspeaker or microphone which uses the device.

Each of the aforementioned provisional applications, Nos. 60/178,315, 60/205,465 and 60/218,062, is incorporated herein by reference.

The invention claimed is:

1. An electromechanical force transducer having an intended operative frequency range and adapted for mounting to a site to which force is to be applied, the transducer having a plurality of bending wave modes distributed in frequency in the operative frequency range, the transducer comprising:

a plurality of resonant elements each having a frequency distribution of bending wave modes in the operative frequency range, at least one connector coupling the plurality of resonant elements together, and a mount mounting the transducer to a site to which a force is to be applied, wherein at least one of the parameters of the transducer is such as to enhance the distribution of bending wave modes in the transducer in the operative frequency range.

2. A transducer according to claim 1, wherein the at least one parameter of the transducer is selected from the group consisting of relative aspect ratios, relative bending stiffnesses, relative thicknesses and relative geometries of the plurality of resonant elements.

3. A transducer according to claim 1, wherein the at least one parameter of the transducer comprises the location of the at least one connector on each of the plurality of resonant elements.

4. A transducer according to claim 1, wherein the at least one parameter of the transducer comprises the location of the mount on the transducer.

5. A transducer according to claim 1, wherein the mount is attached to the transducer at a position which is beneficial for coupling modal activity of the transducer to the site.

6. A transducer according to claim 5, wherein the mount is attached to one of the plurality of resonant elements and is positioned away from the centre of the resonant element.

7. A transducer according to claim 5, wherein the mount is positioned at an antinode of the resonant element.

8. A transducer according to claim 1, wherein the mount comprises more than one coupling point between the resonant element and the site to which force is to be applied.

9. A transducer according to claim 1, wherein at least one resonant element is an active element.

10. A transducer according to claim 9, wherein the at least one active element is selected from the group consisting of piezoelectric, magnetostrictive, electrostrictive and electret devices.

11. A transducer according to claim 1, comprising two resonant elements, each in the form of a beam, having a frequency ratio of 1.27:1.

12. A transducer according to claim 1, comprising three resonant elements, each in the form of a beam, having a frequency ratio of 1.315:1.147:1.

13. A transducer according to claim 1, comprising two resonant disc-like elements having a frequency ratio of 1.1+/−0.02 to 1.

14. A transducer according to claim 1, comprising two resonant disc-like elements, having a frequency ratio of 3.2:1.

15. A transducer according to claim 1, comprising three resonant disc-like elements, having a frequency ratio of 3.03:1.63:1 or 8.19:3.20:1.

16. A transducer according to claim 1, wherein in the operative frequency range the plurality of resonant elements has a density of bending wave modes which is sufficient for the transducer to provide an effective mean average force which is substantially constant with frequency.

17. An electromechanical force transducer having an intended operative frequency range and adapted for mounting to a site to which force is to be applied, the transducer having a plurality of bending wave modes distributed in frequency in the operative frequency range, the transducer comprising:

a resonant element having a frequency distribution of bending wave modes in the operative frequency range, and a mount mounting the transducer to a site to which a force is to be applied, wherein the resonant element is modal along two substantially normal axes, and at least one of the parameters of the transducer is such as to enhance the distribution of bending wave modes in the transducer in the operative frequency range.

18. A transducer according to claim 17, wherein the at least one parameter of the transducer is selected from the group consisting of aspect ratio, bending stiffness and thickness of the resonant element.

19. A transducer according to claim 17, wherein the at least one parameter of the transducer comprises the location of the mount on the transducer.

20. A transducer according to claim 17, wherein the mount is attached to the transducer at a position which is beneficial for coupling modal activity of the transducer to the site.

21. A transducer according to claim 17, wherein the mount is attached to the resonant element and is positioned away from the centre of the resonant element.

22. A transducer according to claim 17, wherein the mount is positioned at an antinode of the resonant element.

23. A transducer according to claim 17, wherein the mount comprises more than one coupling point between the resonant element and the site to which force is to be applied.

24. A transducer according to claim 17, wherein the resonant element is an active element.

25. A transducer according to claim 24, wherein the at least one active element is selected from the group consisting of piezoelectric, magnetostrictive, electrostrictive and electret devices.

26. A transducer according to claim 17, wherein in the operative frequency range the resonant element has a density of bending wave modes which is sufficient for the transducer to provide an effective mean average force which is substantially constant with frequency.

27. An electromechanical force transducer having an intended operative frequency range and adapted for mounting to a site to which force is to be applied, the transducer having a plurality of bending wave modes distributed in frequency in the operative frequency range, the transducer comprising:

a resonant element having frequency distribution of bending wave modes in the operative frequency range, and a mount mounting the transducer to a site to which a force is to be applied, wherein the mount is attached to the resonant element and is positioned away from the centre of the resonant element, and at least one of the parameters of the resonant element is such as to enhance the distribution of bending wave modes in the transducer in the operative frequency range.

28. A transducer according to claim 27, wherein the at least one parameter is selected from the group consisting of aspect ratio, bending stiffness and thickness of the resonant element.

29. A transducer according to claim 27, wherein in the operative frequency range the resonant element has a density of bending wave modes which is sufficient for the transducer to provide an effective mean average force which is substantially constant with frequency.

30. A transducer according to claim 27, wherein the shape of the resonant element is selected to provide an off-centre line of attachment which is generally at the centre of mass of the element.

31. A transducer according to claim 30, wherein the shape of the transducer is trapezoidal.

* * * * *